US008142307B2

(12) United States Patent
Sanchez et al.

(10) Patent No.: US 8,142,307 B2
(45) Date of Patent: Mar. 27, 2012

(54) GOLF CLUB ATTACHMENT MECHANISMS AND METHODS TO ATTACH GOLF CLUBS

(75) Inventors: Richard R. Sanchez, New River, AZ (US); Bradley D. Schweigert, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 108 days.

(21) Appl. No.: 12/491,115

(22) Filed: Jun. 24, 2009

(65) Prior Publication Data

US 2011/0003648 A1 Jan. 6, 2011

Related U.S. Application Data

(63) Continuation-in-part of application No. 12/031,633, filed on Feb. 14, 2008, now Pat. No. 7,736,243.

(60) Provisional application No. 61/020,945, filed on Jan. 14, 2008.

(51) Int. Cl.
*A63B 53/02* (2006.01)

(52) U.S. Cl. ..... 473/288; 473/307; 473/309

(58) Field of Classification Search ..... 473/288, 473/298–299, 307–310, 315, 305
See application file for complete search history.

(56) References Cited

U.S. PATENT DOCUMENTS

| | | | | |
|---|---|---|---|---|
| 1,380,554 | A | | 6/1921 | Hawkesworth |
| 1,895,417 | A | | 1/1933 | Lard |
| 1,906,239 | A | | 5/1933 | Reach |
| 1,930,204 | A | | 10/1933 | Judd et al. |
| 1,982,087 | A | | 11/1934 | Wantz |
| 2,027,452 | A | | 1/1936 | Rusing |
| 2,146,048 | A | | 2/1939 | Barnhart |
| 2,464,850 | A | | 3/1949 | Crawshaw |
| 2,869,907 | A | * | 1/1959 | Deliso ..... 403/359.6 |
| 4,715,474 | A | | 12/1987 | Wehmeyer |
| 4,808,127 | A | | 2/1989 | Swanic |
| 4,852,782 | A | | 8/1989 | Wu et al. |
| 4,854,583 | A | * | 8/1989 | Kobayashi ..... 473/312 |
| 4,943,059 | A | | 7/1990 | Morell |
| 5,385,346 | A | | 1/1995 | Carroll et al. |
| 5,496,029 | A | | 3/1996 | Heath et al. |
| 5,653,645 | A | * | 8/1997 | Baumann ..... 473/305 |
| 5,716,289 | A | | 2/1998 | Okoneski |
| 5,863,260 | A | | 1/1999 | Butler, Jr. et al. |
| 5,951,411 | A | | 9/1999 | Wood et al. |
| 6,039,659 | A | | 3/2000 | Hamm |
| 6,238,303 | B1 | | 5/2001 | Fite |
| RE38,605 | E | | 9/2004 | Kubica et al. |
| 6,875,114 | B2 | | 4/2005 | Barron et al. |
| 7,017,252 | B2 | | 3/2006 | Lenhof et al. |
| 7,083,529 | B2 | * | 8/2006 | Cackett et al. ..... 473/309 |
| 7,207,897 | B2 | | 4/2007 | Burch et al. |
| 7,300,359 | B2 | * | 11/2007 | Hocknell et al. ..... 473/309 |
| 2001/0007835 | A1 | | 7/2001 | Baron |
| 2001/0011042 | A1 | | 8/2001 | Roark |

(Continued)

FOREIGN PATENT DOCUMENTS

| | | |
|---|---|---|
| CA | 2421127 | 9/2004 |
| GB | M12200 | 6/1913 |
| GB | 879553 | 10/1961 |

(Continued)

*Primary Examiner* — Stephen L. Blau

(57) ABSTRACT

Embodiments of golf club attachment mechanisms and methods to attach golf clubs are described herein. Other embodiments and related methods are also disclosed herein.

28 Claims, 17 Drawing Sheets

U.S. PATENT DOCUMENTS

| | | | | |
|---|---|---|---|---|
| 2004/0018886 | A1 | 1/2004 | Burrows | |
| 2004/0102256 | A1 | 5/2004 | Kumamoto | |
| 2004/0185945 | A1* | 9/2004 | Barron et al. | 464/157 |
| 2005/0176521 | A1 | 8/2005 | Burch et al. | |
| 2006/0264266 | A1 | 11/2006 | Jung | |
| 2006/0281575 | A1* | 12/2006 | Hocknell et al. | 473/306 |
| 2007/0078026 | A1 | 4/2007 | Holt et al. | |
| 2007/0265106 | A1 | 11/2007 | Burrows | |
| 2008/0254908 | A1 | 10/2008 | Bennett et al. | |
| 2009/0239678 | A1* | 9/2009 | De La Cruz et al. | 473/305 |

FOREIGN PATENT DOCUMENTS

| | | |
|---|---|---|
| GB | 899562 | 6/1962 |
| GB | 2109249 | 6/1983 |
| GB | 2456368 | 7/2009 |
| JP | 2000157650 | 6/2000 |
| WO | WO9745172 | 12/1997 |
| WO | WO2004009186 | 1/2004 |

* cited by examiner

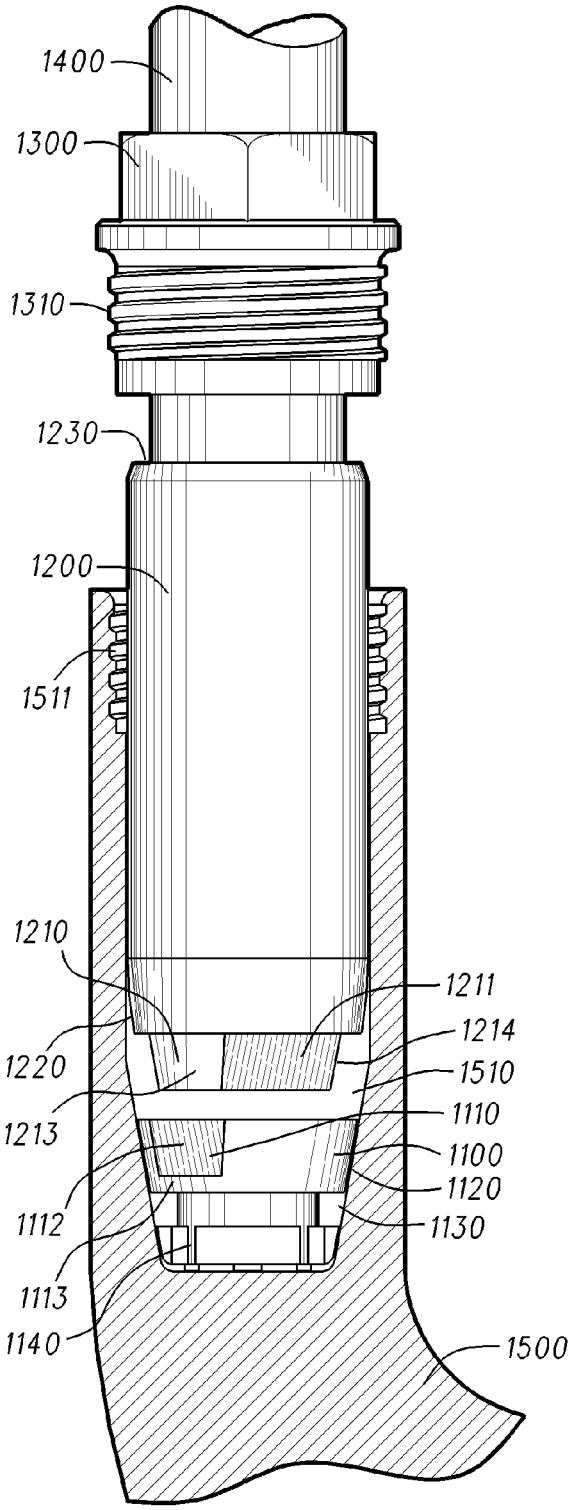
1000 Fig. 1
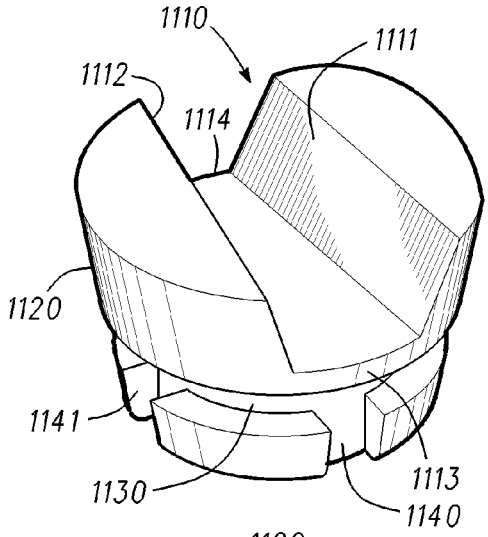
1100
Fig. 2
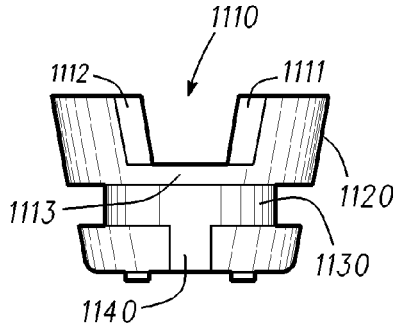
1100
Fig. 3

1300

1300

1300

1300

14000

27200

27100

27200

27200

GOLF CLUB ATTACHMENT MECHANISMS AND METHODS TO ATTACH GOLF CLUBS

CROSS REFERENCE TO RELATED APPLICATIONS

This application is a continuation in part of U.S. patent application Ser. No. 12/031,633, filed Feb. 14, 2008 now U.S. Pat. No. 7,736,243, which claims priority from U.S. Provisional Patent Application No. 61/020,945, filed Jan. 14, 2008.

TECHNICAL FIELD

This disclosure relates generally to golf equipment, and relates more particularly to golf club attachment mechanisms and methods of manufacturing and operating golf club attachment mechanisms.

BACKGROUND

In some sports, an equipment fitting process may match an individual with equipment to help him or her play to the best of his or her abilities. In one example, the individual may be custom-fitted for a complete set of golf clubs (e.g., woods, irons, wedges, putter, etc.). A golf club fitter may allow the individual to try out various combinations of golf club heads and shafts. To properly fit the individual with a set of golf clubs, the golf club fitter may determine various preferences and/or characteristics of the individual (e.g., gender, height, age, wrist-to-floor distance, swing speed, etc.). In one example, a golf club fitter may determine whether the individual prefers to play with either right-handed golf clubs or left-handed golf clubs so that the individual may be fitted with proper golf equipment.

BRIEF DESCRIPTION OF THE DRAWINGS

FIG. 1 illustrates a side view of a golf club attachment mechanism having a hosel adapter, a shaft adapter, and a cap in a disengaged state, according to a first embodiment.

FIG. 2 illustrates a perspective view of the hosel adapter from FIG. 1.

FIG. 3 illustrates a side view of the hosel adapter from FIG. 1.

Figure 4:
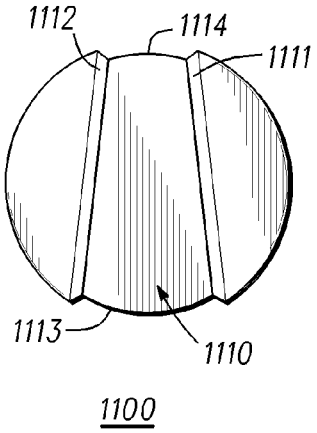
FIG. 4 illustrates a top view of the hosel adapter from FIG. 1.

For simplicity and clarity of illustration, the drawing figures illustrate the general manner of construction, and descriptions and details of well-known features and techniques may be omitted to avoid unnecessarily obscuring of the drawings. Additionally, elements in the drawing figures are not necessarily drawn to scale. For example, the dimensions of some of the elements in the figures may be exaggerated relative to other elements to help improve understanding of different embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the golf club attachment mechanism and related methods described herein are, for example, capable of operation in sequences other than those illustrated or otherwise described herein. Furthermore, the terms "include," and "have," and any variations thereof, are intended to cover a non-exclusive inclusion, such that a process, method, system, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the golf club attachment mechanism and related methods described herein are, for example, capable of operation in other orientations than those illustrated or otherwise described herein. The term "coupled," as used herein, is defined as directly or indirectly connected in an electrical, physical, mechanical, or other manner. The term "on," as used herein, is defined as on, at, or otherwise adjacent to or next to or over.

The terms "couple," "coupled," "couples," "coupling," and the like should be broadly understood and refer to connecting two or more elements or signals, electrically and/or mechanically, either directly or indirectly through intervening circuitry and/or elements. Two or more electrical elements may be electrically coupled, either direct or indirectly, but not be mechanically coupled; two or more mechanical elements may be mechanically coupled, either direct or indirectly, but not be electrically coupled; two or more electrical elements may be mechanically coupled, directly or indirectly, but not be electrically coupled. Coupling (whether only mechanical, only electrical, or both) may be for any length of time, e.g., permanent or semi-permanent or only for an instant.

The absence of the word "removably," "removable," and the like near the word "coupled," and the like does not mean that the coupling, etc. in question is or is not removable.

DETAILED DESCRIPTION

In one example, a golf club attachment mechanism comprises a hosel adapter with a first slot coupler across a top portion of the hosel adapter, and a shaft adapter with a second slot coupler across a bottom portion of the shaft adapter. The second slot coupler of the shaft adapter is complementary to the first slot coupler of the hosel adapter. The first slot coupler and the second slot coupler couple together to restrict a rotational movement of the hosel adapter relative to the shaft adapter.

In another example, a golf club attachment mechanism comprises a first female coupler of one or more female couplers at a bottom surface of a shaft receiver of a club head, and a first male coupler of one or more male couplers at a bottom surface of a shaft adapter. A centerpoint of the first female coupler is offset from a centerpoint of the bottom surface of the shaft receiver, while a centerpoint of the first male coupler is offset from a centerpoint of the bottom surface of the shaft adapter. The shaft adapter is configured to couple with an end of a club shaft, and the first male coupler is configured to interlock with the first female coupler to restrict a rotational movement of the shaft adapter relative to the shaft receiver. Other examples of golf club attachment mechanisms and of methods to attach golf clubs are disclosed below.

Figure 5:
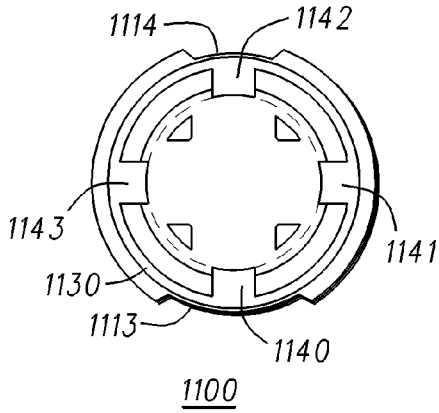
FIG. 5 illustrates a bottom view of the hosel adapter from FIG. 1.
Figure 6:
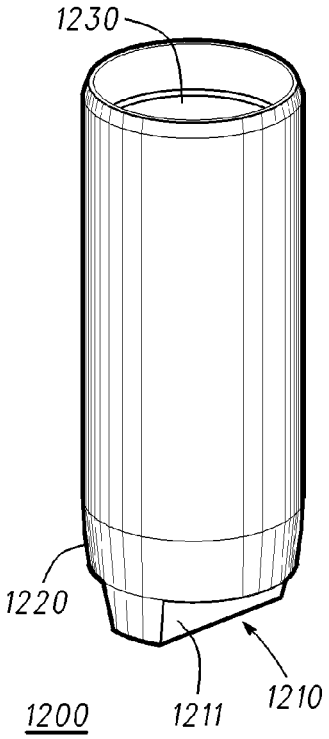
FIG. 6 illustrates a perspective view of the shaft adapter from FIG. 1.
Figure 8:
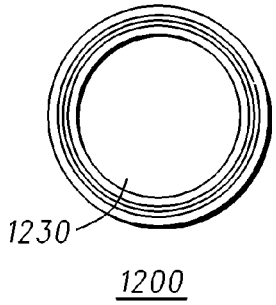
FIG. 8 illustrates a top view of the shaft adapter from FIG. 1.
Figure 9:
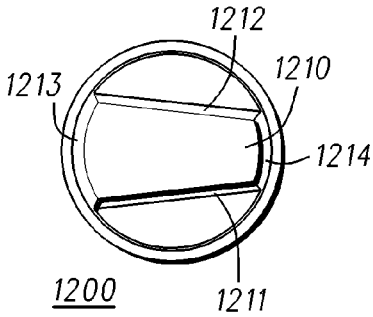
FIG. 9 illustrates a bottom view of the shaft adapter from FIG. 1.
Figure 7:
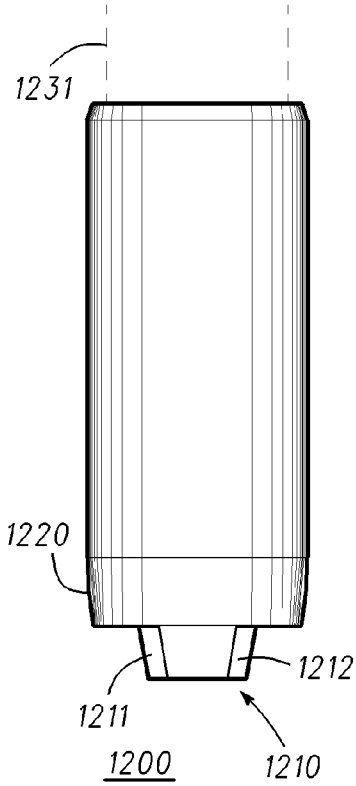
FIG. 7 illustrates a side view of the shaft adapter from FIG. 1.
Figure 10:
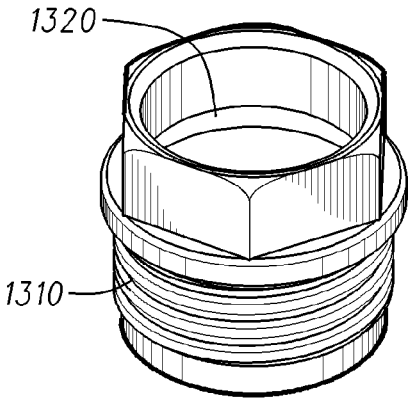
FIG. 10 illustrates a perspective view of the cap from FIG. 1.
Figure 11:
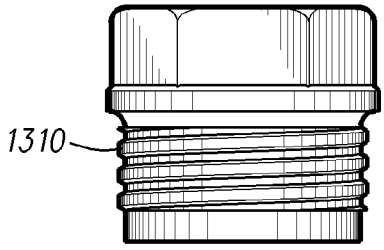
FIG. 11 illustrates a side view of the cap from FIG. 1.
Figure 12:
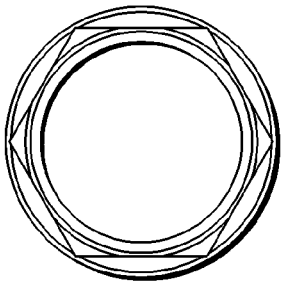
FIG. 12 illustrates a top view of the cap from FIG. 1.
Figure 13:
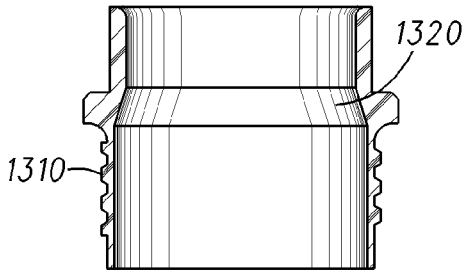
FIG. 13 illustrates a cross-sectional side view of the cap from FIG. 1.
Figure 24:
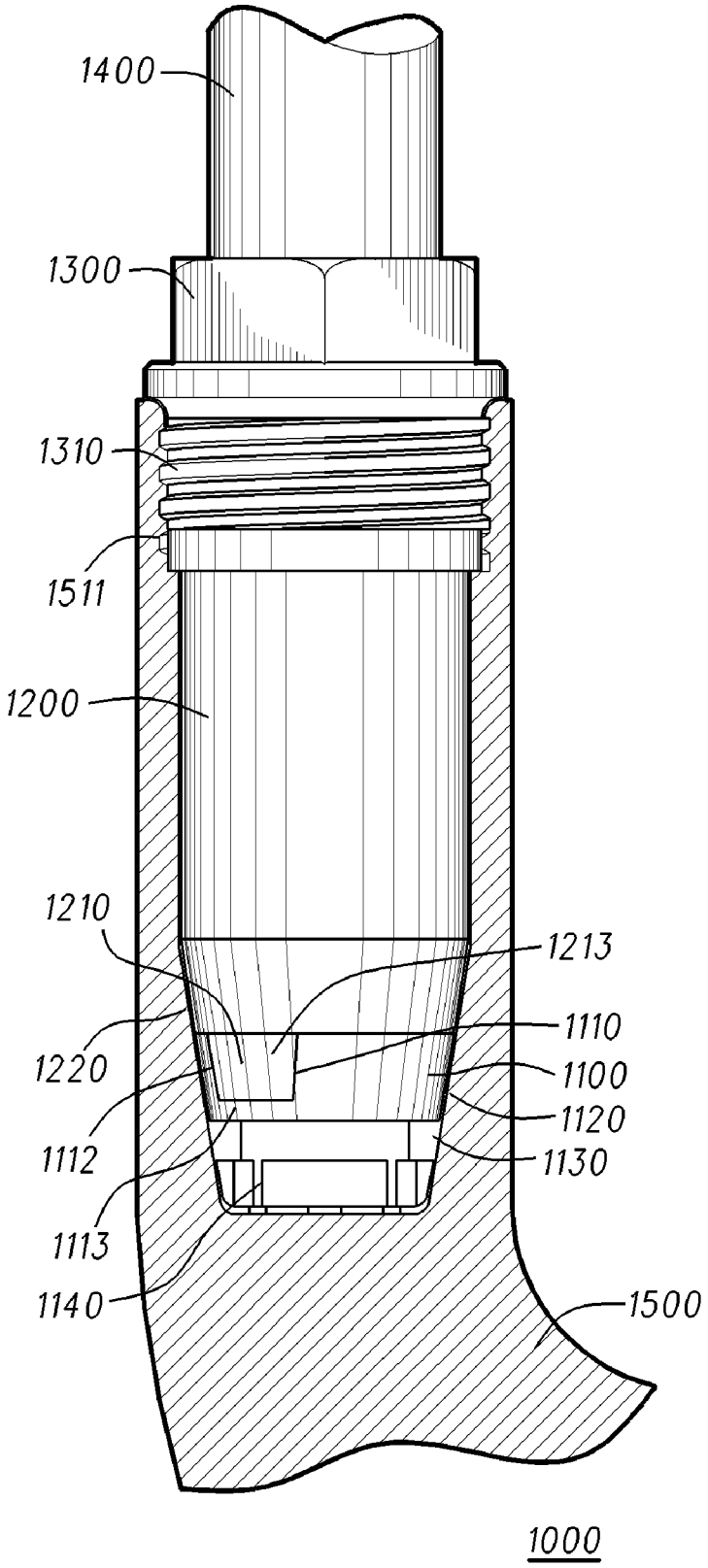
FIG. 24 illustrates a side view of the golf club attachment mechanism of FIG. 1 in an engaged state.

Referring now to the figures, FIG. 1 illustrates a side view of mechanism 1000 in a disengaged state. Mechanism 1000 includes hosel adapter 1100, shaft adapter 1200, and cap 1300, which are shown ready to be assembled to couple together golf club shaft 1400 and golf club head 1500. A portion of golf club head 1500 is shown in a cross-sectional view. FIG. 2 illustrates a perspective view of hosel adapter 1100. FIG. 3 illustrates a side view of hosel adapter 1100. FIG. 4 illustrates a top view of hosel adapter 1100. FIG. 5 illustrates a bottom view of hosel adapter 1 100. FIG. 6 illustrates a perspective view of shaft adapter 1200. FIG. 7 illustrates a side view of shaft adapter 1200. FIG. 8 illustrates a top view of shaft adapter 1200. FIG. 9 illustrates a bottom view of shaft adapter 1200. FIG. 10 illustrates a perspective view of cap 1300. FIG. 11 illustrates a side view of cap 1300. FIG. 12 illustrates a top view of cap 1300. FIG. 13 illustrates a cross-sectional side view of cap 1300. Skipping ahead in the figures, FIG. 24 illustrates a side view of mechanism 1000 in an engaged state, showing hosel adapter 1100, shaft adapter 1200, and cap 1300 assembled to couple together golf club shaft 1400 with golf club head 1500.

Golf club shaft 1400 can comprise any various golf club shaft made of various materials (e.g. steel, graphite, etc.) with various characteristics (e.g., flex, bend point, etc.). In the same or a different example, golf club shaft 1400 may be manufactured or otherwise modified to accommodate the use of mechanism 1000. In the same or a different example, golf club shaft 1400 can be manufactured or designed to limit flexing to be: (a) along a flex plane relative to a swing path of golf club shaft 1400 and/or (b) at one or more regions of golf club shaft 1400.

Similarly, golf club head 1500 in FIGS. 1-13 can comprise a golf club head, including putter, iron, hybrid, fairway wood, and driver-type golf club heads. Golf club head 1500 also comprises hosel 1510. In the same or a different example, hosel 1510 may be manufactured or modified to accommodate mechanism 1000. For example, hosel 1510 may be bored or drilled to accommodate shaft adapter 1200 and hosel adapter 1100. In the same or a different example, hosel 1510 may be modified to include hosel fastener 1511 that can be used to couple cap 1300 to hosel 1510. In the example illustrated in FIG. 1, hosel fastener 1511 is located at a top portion of hosel 1510, and comprises screw threads at the periphery of hosel 1510. Other types of hosel fasteners besides screw threads can be used without departing from the embodiments disclosed herein.

In a different embodiment, golf club head 1500 can be devoid of a hosel, and just have a hole in which mechanism 1000 is inserted. In this embodiment, hosel adapter 1100 can be inserted into the hole of the golf club head. Therefore, hosel adapter 1100 and other hosel adapters described later can also be used with hosel-less golf club heads.

Proceeding now to describing the elements of mechanism 1000, FIGS. 1-13 illustrate hosel adapter 1100, shaft adapter 1200, and cap 1300. In the present example illustrated in FIGS. 1-5, hosel adapter 1100 comprises slot coupler 1110 across a top portion of hosel adapter 1100. In some embodiments, hosel adapter 1100 can be referred to as a hosel plug, while slot coupler 1110 can comprise a slot or a trench located at a top end of hosel adapter 1100.

Hosel adapter 1100 is designed to couple within hosel 1510 of golf club head 1500. To assist in coupling with hosel 1510, a perimeter of hosel adapter 1100 comprises groove 1 130. In the example shown in FIGS. 1-5, groove 1130 of hosel adapter 1100 circumscribes the perimeter of hosel adapter 1100 completely in a substantially horizontal plane with respect to hosel 1510. In other embodiments, groove 1130 could circumscribe the perimeter of hosel adapter 1100 only partially or non-continuously, and/or there could be other similar grooves in addition to groove 1130.

In addition, hosel adapter 1100 further comprises groove 1140, which is substantially perpendicular to groove 1130. In the example shown in FIGS. 1-5, groove 1140 is also located at the perimeter of hosel adapter 1100, but is substantially vertical to groove 1130. In the present embodiment, hosel adapter 1100 also comprises grooves 1141, 1142, and 1143, which are similar to groove 1140 but located at different points of the perimeter of hosel adapter 1100. Grooves 1140, 1141, 1142, and 1143 can be equidistant from each other.

In the present example, as shown in FIG. 1, hosel adapter 1100 comprises tapering 1120 that allows hosel adapter 1100 to fit complementary to an inner perimeter at a bottom portion of hosel 1510. To couple hosel adapter 1100 and hosel 1510 together, an epoxy material (not shown) can be applied between the perimeter of hosel adapter 1100 and the inner perimeter of hosel 1510. Groove 1130 and/or grooves 1140, 1141, 1142, and/or 1143 can serve to channel the epoxy material throughout the perimeter of hosel adapter 1100, and to provide enhanced surface area to which the epoxy material can more firmly attach while securing hosel adapter 1100 to hosel 1510.

Continuing with the elements of mechanism 1000, in the present example illustrated in FIGS. 1 and 6-9, shaft adapter 1200 comprises slot coupler 1210 across a bottom portion of shaft adapter 1200. In some embodiments, shaft adapter 1200 can be referred to as a shaft sleeve, while slot coupler 1210 can comprise a tab or a protrusion located at a bottom end of shaft adapter 1200. Slot coupler 1210 of shaft adapter 1200 is complementary to slot coupler 1110 of hosel adapter 1100, as will be further described below.

Shaft adapter 1200 is designed to couple with an end of golf club shaft 1400. In the present example, as better illustrated in FIGS. 6-9 shaft adapter 1200 comprises bore 1230 complementary to an exterior perimeter of golf club shaft 1400. FIG. 1 shows shaft adapter 1200 of the present example coupled to golf club shaft 1400, with the end of golf club shaft 1400 already inserted into bore 1230 of shaft adapter 1200. In a different example, instead of bore 1230, shaft adapter 1200 could comprise rod 1231, shown in outline form in FIG. 7, to couple within an interior perimeter (not shown) of the end of golf club shaft 1400. Shafter adapter 1200 can be epoxied to golf club shaft 1400.

In the present example, as shown in FIG. 1, shaft adapter 1200 comprises tapering 1220, which can allow shaft adapter 1200 to couple with hosel adapter 1100 while fitting complementary to the inner perimeter of hosel 151 0. Tapering 1220 can be substantially continuous with tapering 1120 of hosel adapter 1100 when shaft adapter 1200 and hosel adapter 1100 are coupled together.

Carrying on with the elements of mechanism 1000, as illustrated in FIG. 1 for the present example, cap 1300 is located at least partially above shaft adapter 1200 while circumscribing the exterior perimeter of golf club shaft 1400. In some embodiments, cap 1300 can be referred to as a nut.

As illustrated in FIGS. 1 and 10-13, cap 1300 comprises cap fastener 1310 at a perimeter of cap 1300. In the example illustrated in FIGS. 1, and 10-13, cap fastener 1310 comprises screw threads which are complementary to the screw threads of hosel fastener 1511 described earlier for hosel 1510. Besides screw threads, other combinations of complementary cap and hosel fasteners are possible without deviating from the embodiments presented herein. In some embodiments, cap fastener 1310 can be referred to as a nut fastener.

In the present example, at least part of an interior perimeter of cap 1300 is complementary with, and fits around, an exterior perimeter of shaft adapter 1200 while cap fastener 1310 couples with hosel fastener 1511. In addition, as better illustrated in FIGS. 10 and 13, cap 1300 further comprises cap flange 1320, which may be referred to as a nut flange in some embodiments. In the present embodiment, cap flange 1320 comprises an interior flange that narrows part of the inner perimeter of cap 1300 to a dimension complementary to the exterior perimeter of golf club shaft 1400. In other embodiments, cap flange 1320 can be located at a bottom side of cap 1300, and all of the interior perimeter of cap 1300 can be complementary to the exterior perimeter of golf club shaft 1400.

To engage mechanism 1000, as better illustrated in FIG. 1 for the present example, cap flange 1320 engages a top end of shaft adapter 1200, pushing shaft adapter 1200 against hosel adapter 1100 while cap fastener 1310 couples with hosel fastener 1511. This interaction causes slot coupler 1210 of shaft adapter 1200 to engage slot coupler 1110 of hosel adapter 1100. When coupled together as such, slot couplers 1210 and 1110 restrict a rotational movement of hosel adapter 1100 relative to shaft adapter 1200, and this in turn maintains golf club shaft 1400 and golf club head 1500 at a predetermined desired orientation with respect to each other. In some embodiments, hosel adapter 1100 and shaft adapter 1200 remain entirely within hosel 1510 when cap 1300 is fully coupled to hosel 1510.

Continuing with a further description of the interaction between shaft adapter 1200 and hosel adapter 1100 of mechanism 1000, in the present example of FIGS. 1-13, slot coupler 1110 comprises a slot, while slot coupler 1210 comprises a tab complementary to the slot of slot coupler 1110. In at least some embodiments, slot coupler 1110 can comprise a trench, while slot coupler 1210 can comprise a protrusion complementary to the trench of slot coupler 1110. In a different example, the physical attributes of slot couplers 1110 and 1210 could be inverted, where slot coupler 1210 would comprise a slot or a trench, while slot coupler 1110 would comprise a tab or protrusion complementary to the slot of slot coupler 1210.

In the present example, as shown in FIGS. 1-9, slot coupler 1110 further comprises surface 1111 and surface 1112, where surface 1112 in non-planar and non-parallel to surface 1111 in two dimensions. Similarly, slot coupler 1210 further comprises surface 1211 and surface 1212, where surface 1212 is non-planar and non-parallel to surface 1211 in two dimensions. In at least some embodiments, surfaces 1111, 1112, 1211, and/or 1212 can be referred as walls.

As better illustrated in FIGS. 4 and 9 for the present embodiment, slot coupler 1110 tapers across the top portion of hosel adapter 1100, from end 1113 to end 1114, where end 1114 of slot coupler 1110 is narrower than end 1113 of slot coupler 1110 in two dimensions. In addition, slot coupler 1210 tapers complementary to slot coupler 1110 across the bottom portion of shaft adapter 1200, from end 1213 to end 1214, where end 1214 of slot coupler 1210 is narrower than end 1213 of slot coupler 1210 in two dimensions. The tapering of slot couplers 1110 and 1210 is reflected by a varying width between surfaces 1111 and 1112, and between surfaces 1211 and 1212.

In the present example, when slot couplers 1110 and 1210 are coupled together while mechanism 1000 is engaged, surface 1111 of slot coupler 1110 engages surface 1211 of slot coupler 1210, while surface 1112 of slot coupler 1110 engages surface 1212 of slot coupler 1210. In some embodiments, slot coupler 1110 further comprises a slope, which changes the depth of the slot or trench, while slot coupler 1210 comprises a slope complementary to the slope of slot coupler 1110, which changes the height of the tab or protrusion. In these embodiments, the dimensions of slot couplers 1110 and 1210 vary in three dimensions from end to end.

For the example of FIGS. 1-13, due to the varying width between, and the complementary nature of, surfaces 1111, 1112, 1211, and 1212, slot couplers 1110 and 1210 are coupled together at a specific orientation with respect to each other. Otherwise, the tab of slot coupler 1210 would not fit within the slot of slot coupler 1110, and cap 1300 would therefore not be able to push shaft adapter 1200 far enough into hosel 1510 to allow hosel fastener 1511 and cap fastener 1310 to properly engage mechanism 1000.

In contrast, when mechanism 1000 is properly engaged by securing cap 1300 to maintain slot couplers 1110 and 1210 coupled together, the interaction between complementary surfaces 1111, 1112, 1211, and 1212 maintain the relative alignment of shaft adapter 1200 and hosel adapter 1100 to each other. This engagement, in turn, sustains the predetermined desired orientation of golf club shaft 1400 relative to golf club head 1500.

Figure 14:
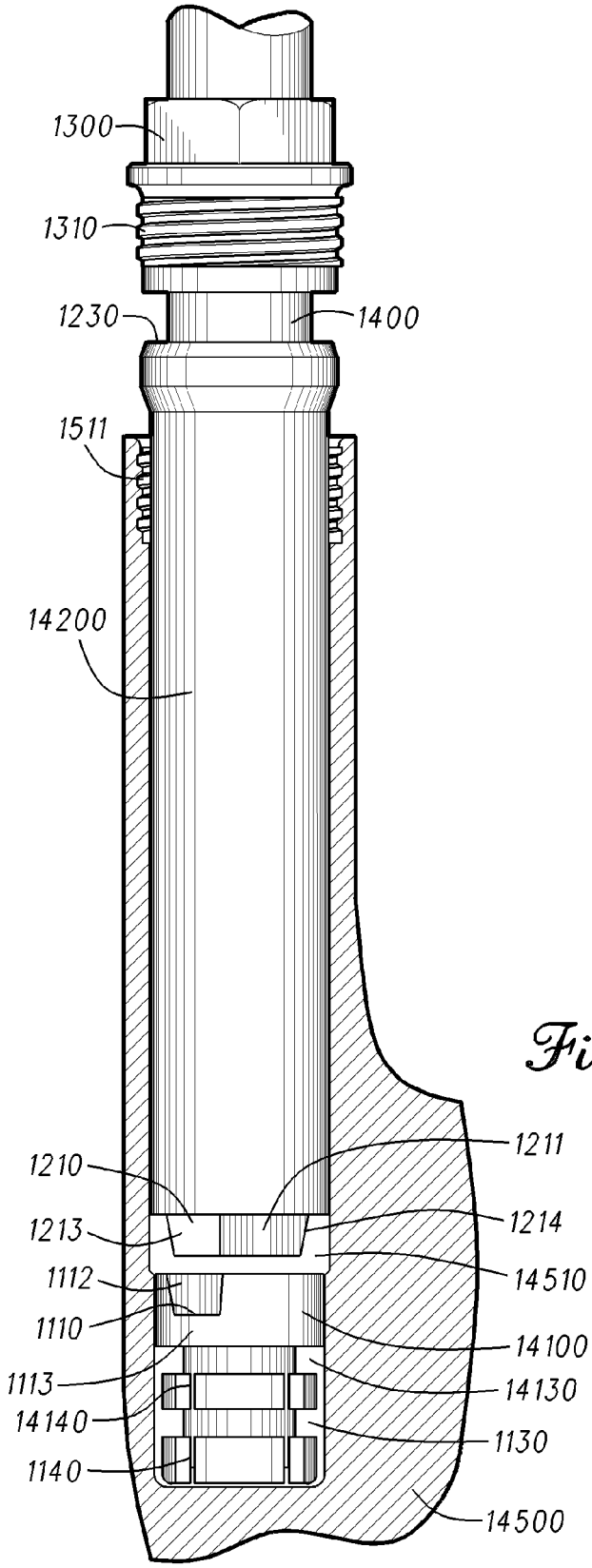
FIG. 14 illustrates a side view of a golf club attachment mechanism in a disengaged state, according to a second embodiment.
Figure 15:
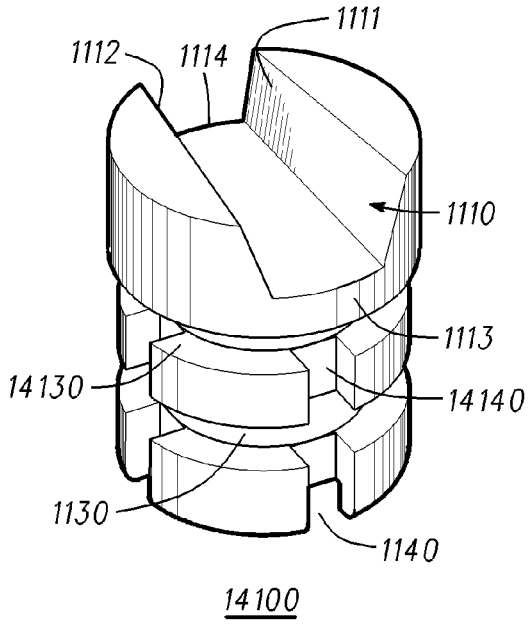
FIG. 15 illustrates a perspective view of a hosel adapter from the golf club attachment mechanism of FIG. 14.
Figure 16:
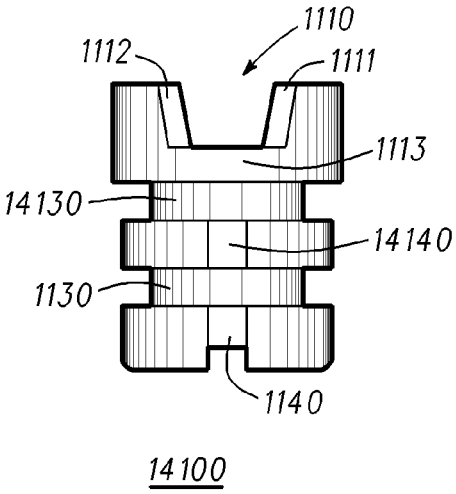
FIG. 16 illustrates a side view of the hosel adapter of FIG. 15.
Figure 17:
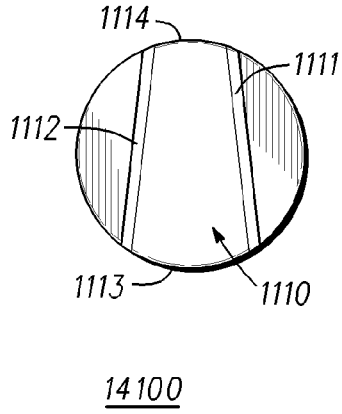
FIG. 17 illustrates a top view of the hosel adapter of FIG. 15.
Figure 18:
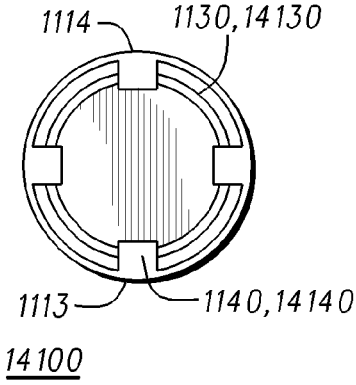
FIG. 18 illustrates a bottom view of the hosel adapter of FIG. 15.
Figure 19:
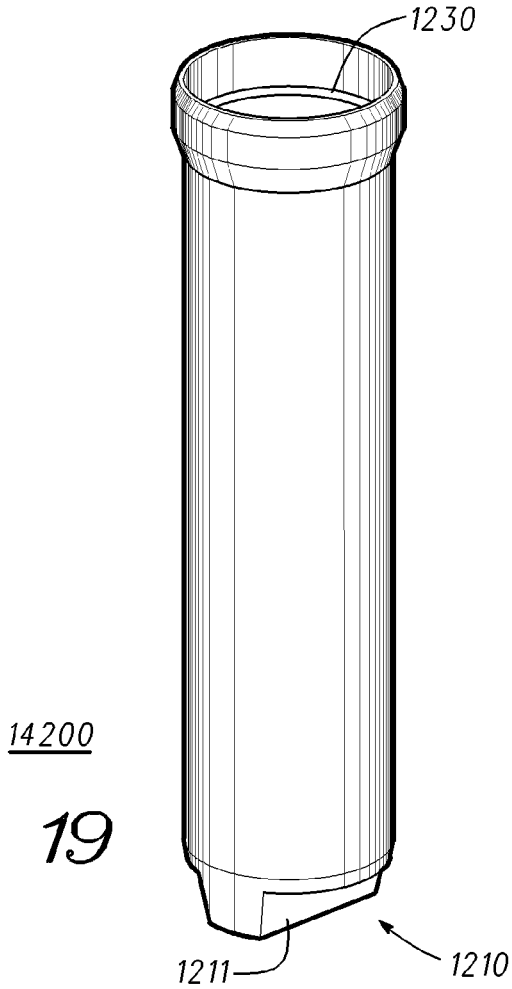
FIG. 19 illustrates a perspective view of a shaft adapter from the golf club attachment mechanism of FIG. 14.
Figure 20:
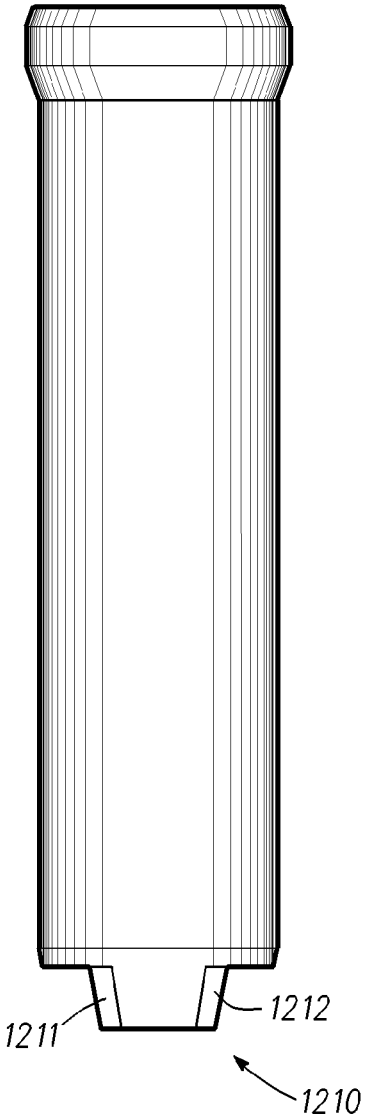
FIG. 20 illustrates a side view of the shaft adapter of FIG. 19.
Figure 21:
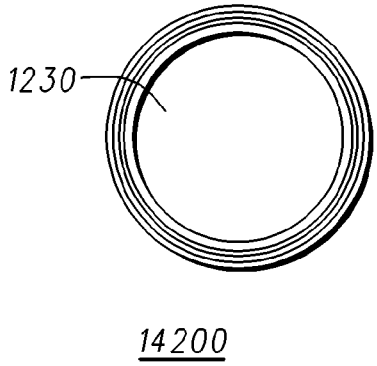
FIG. 21 illustrates a top view of the shaft adapter of FIG. 19.
Figure 22:
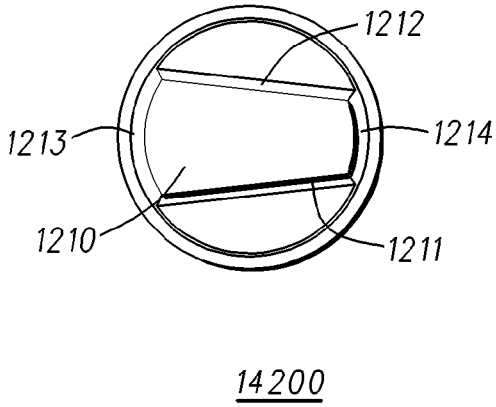
FIG. 22 illustrates a bottom view of the shaft adapter of FIG. 19.
Figure 25:
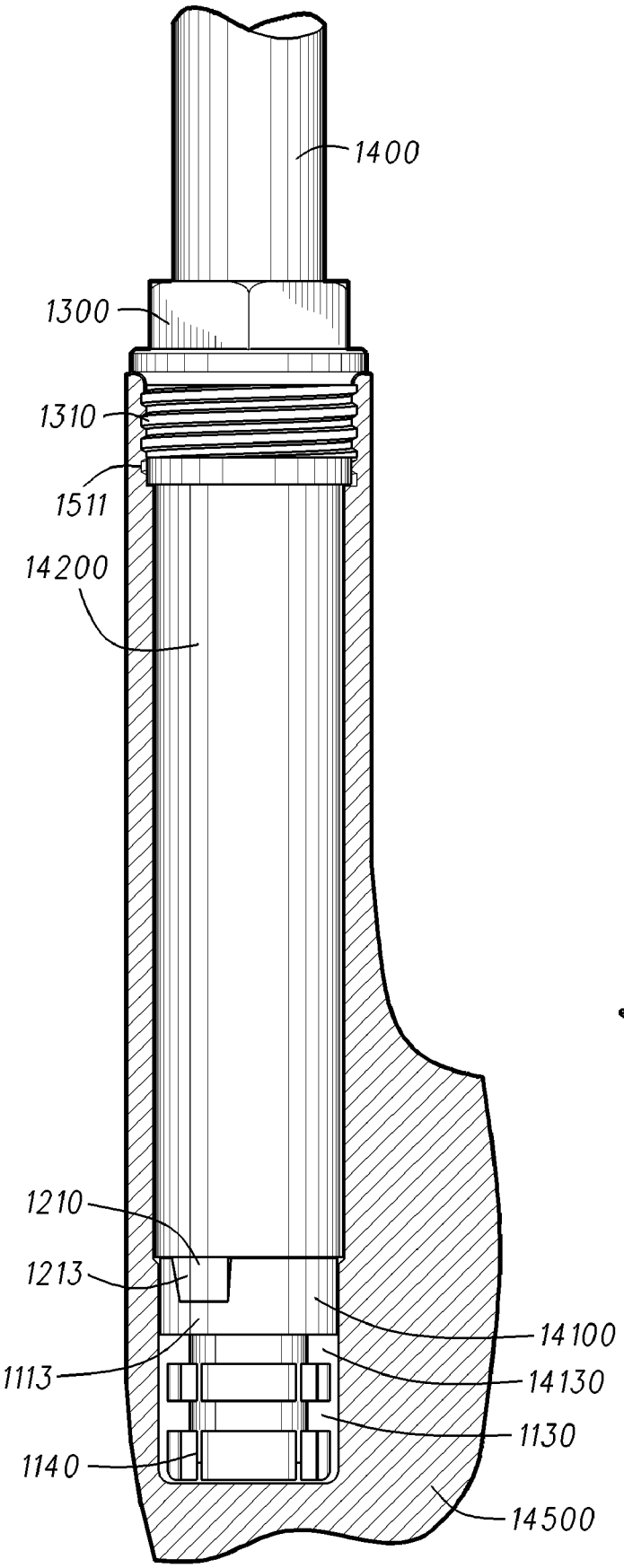
FIG. 25 illustrates a side view of the golf club attachment mechanism of FIG. 14 in an engaged state.

Continuing with the figures, FIG. 14 illustrates a side view of mechanism 14000 in a disengaged state. Mechanism 14000 includes hosel adapter 14100, shaft adapter 14200, and cap 1300, which are shown ready to be assembled to couple together golf club shaft 1400 and golf club head 14500. A portion of golf club head 14500 is shown in a cross-sectional view. FIG. 15 illustrates a perspective view of hosel adapter 14100. FIG. 16 illustrates a side view of hosel adapter 14100. FIG. 17 illustrates a top view of hosel adapter 14100. FIG. 18 illustrates a bottom view of hosel adapter 14100. FIG. 19 illustrates a perspective view of shaft adapter 14200. FIG. 20 illustrates a side view of shaft adapter 14200. FIG. 21 illustrates a top view of shaft adapter 14200. FIG. 22 illustrates a bottom view of shaft adapter 14200. Skipping ahead in the figures, FIG. 25 illustrates a side view of mechanism 14000 in an engaged state, showing hosel adapter 14100, shaft adapter 14200, and cap 1300 assembled to couple together golf club shaft 1400 with golf club head 14500.

Mechanism 14000 is similar to mechanism 1000 of FIGS. 1-13, serving similar purposes for coupling golf club heads and golf club shafts together at a predetermine desired orientation with respect to each other. In the present embodiment, however, an inner perimeter of hosel 14510 of golf club shaft 14500 is substantially constant, and thus does not vary in width in contrast to hosel 1510 in FIG. 1. In at least some embodiments, golf club head 14500 can comprise a driver-type golf club head, where a material thickness around hosel 14510 is sufficient to accommodate mechanism 14000 and maintain structural integrity without needing to vary a width of the inner perimeter for hosel 14510. This contrasts with golf club head 1500 (FIG. 1), where the varying width of the inner perimeter of hosel 1510 can compensate for a thinner material thickness around hosel 1510, allowing sufficient structural integrity for hosel 1510 to resist impact forces while still accommodating mechanism 1000.

As illustrated in FIGS. 14 and 19-22, mechanism 14000 comprises a shaft adapter 14200, which is similar to shaft adapter 1200 of mechanism 1000 in FIGS. 1 and 6-9. In the present example, shaft adapter 14200 comprises no tapering, unlike shaft adapter 1200 which comprises tapering 1220. Furthermore, as illustrated in FIGS. 14-18, mechanism 14000 comprises a hosel adapter 14100, which is similar to hosel adapter 1100 of mechanism 1000 in FIGS. 1-5. However, because the inner perimeter of hosel 14510 is substantially constant, hosel adapter 14100 too has a substantially constant perimeter. Thus, hosel adapter 14100 comprises no tapering, in contrast to hosel adapter 1100 which does comprise tapering 1120 (FIGS. 1-3).

Hosel adapter 14100 (FIGS. 14-18) shares with hosel adapter 1100 (FIGS. 1-5) grooves 1130 and 1140. In addition, hosel adapter 14100 further comprises additional grooves 14130 and 14140. Groove 14130 is similar and substantially parallel to groove 1130. Groove 14140 is similar and substantially parallel to, and can be collinear with, groove 1140, and is further substantially perpendicular to grooves 1130 and 14130. The additional grooves serve the same purpose of grooves 1130 and 1140, but allow greater surface area for the epoxy material to attach to while securing hosel adapter 14100 to hosel 14510.

Figure 23:
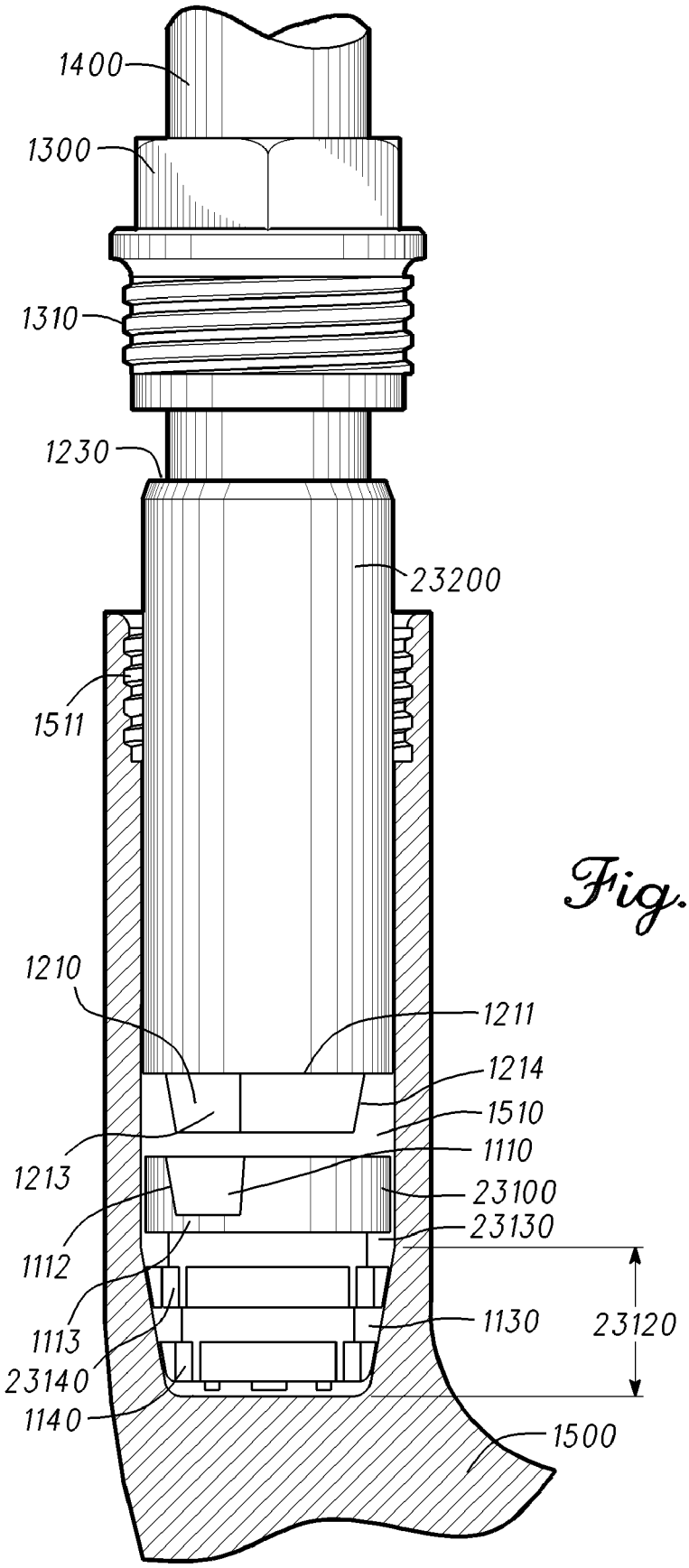
FIG. 23 illustrates a side view of a golf club attachment mechanism in a disengaged state, according to a third embodiment.
Figure 26:
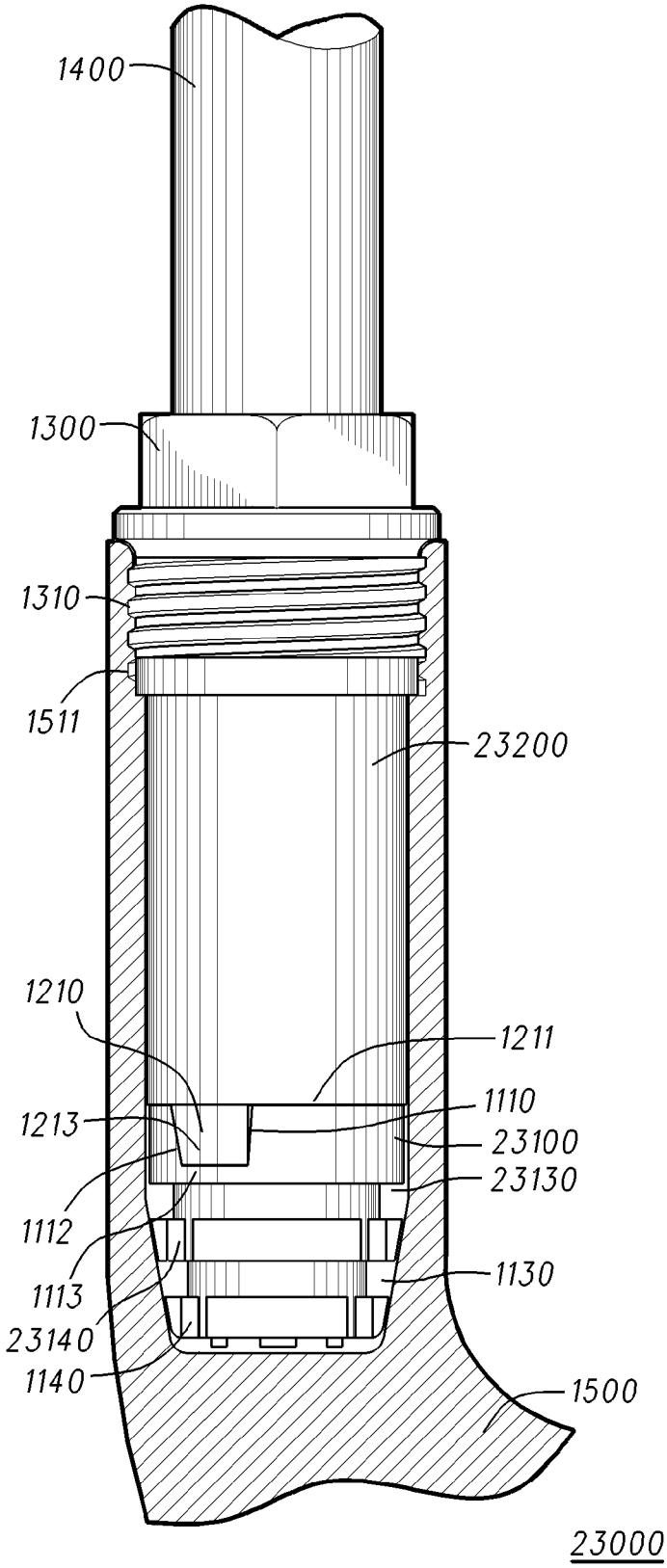
FIG. 26 illustrates a side view of the golf club attachment mechanism of FIG. 23 in an engaged state.

Continuing with the figures, FIG. 23 illustrates a side view of mechanism 23000 in a disengaged state. Mechanism 23000 includes hosel adapter 23100, shaft adapter 23200, and cap 1300, which are shown ready to be assembled to couple together golf club shaft 1400 and golf club head 1500. FIG. 26 illustrates a side view of mechanism 23000 in an engaged state, showing hosel adapter 23100, shaft adapter 23200, and cap 1300 assembled to couple together golf club shaft 1400 with golf club head 1500. Mechanism 23000 is similar to mechanism 1000 of FIGS. 1-13, differing mainly in how the different elements of mechanism 23000 conform to the inner perimeter of hosel 1510.

Mechanism 23000 comprises a shaft adapter 23200, which is similar to shaft adapter 1200 of mechanism 1000 in FIGS. 1 and 6-9. In the present example, shaft adapter 23200 comprises no tapering, unlike shaft adapter 1200 which comprises tapering 1220.

In addition, mechanism 23000 comprises a hosel adapter 23100, which is similar to hosel adapter 1100 of mechanism 1000 in FIGS. 1-5. Hosel adapter 23100, which is longer than hosel adapter 1100, compensates for the shorter length of shaft adapter 23200, as compared to shaft adapter 1200. As a result, tapering 23120 of hosel adapter 23100 engages a full height of the bottom portion of the inner perimeter of hosel 1510 that varies in width. Thus, shaft adapter 23200 can be devoid of any tapering. This configuration contrasts with hosel adapter 1100 as shown in FIGS. 1-3, where tapering 1120 only partially engages the height of the bottom portion of hosel 1510, thus requiring shaft adapter 1200 to have its own tapering 1220 to accommodate the inner perimeter of hosel 1510.

Hosel adapter 23100 shares with hosel adapter 1100 (FIGS. 1-5) grooves 1130 and 1140. In addition, hosel adapter 23100 can further comprise additional grooves, such as grooves 23130 and 23140. Groove 23130 is similar and substantially parallel to groove 1130, while groove 23140 is similar and substantially parallel to groove 1140, and further substantially perpendicular to groove 23130. The additional grooves serve the same purpose of grooves 1130 and 1140, but allow greater surface area for the epoxy material to attach to while securing hosel adapter 23100 to hosel 1510.

Figure 27:
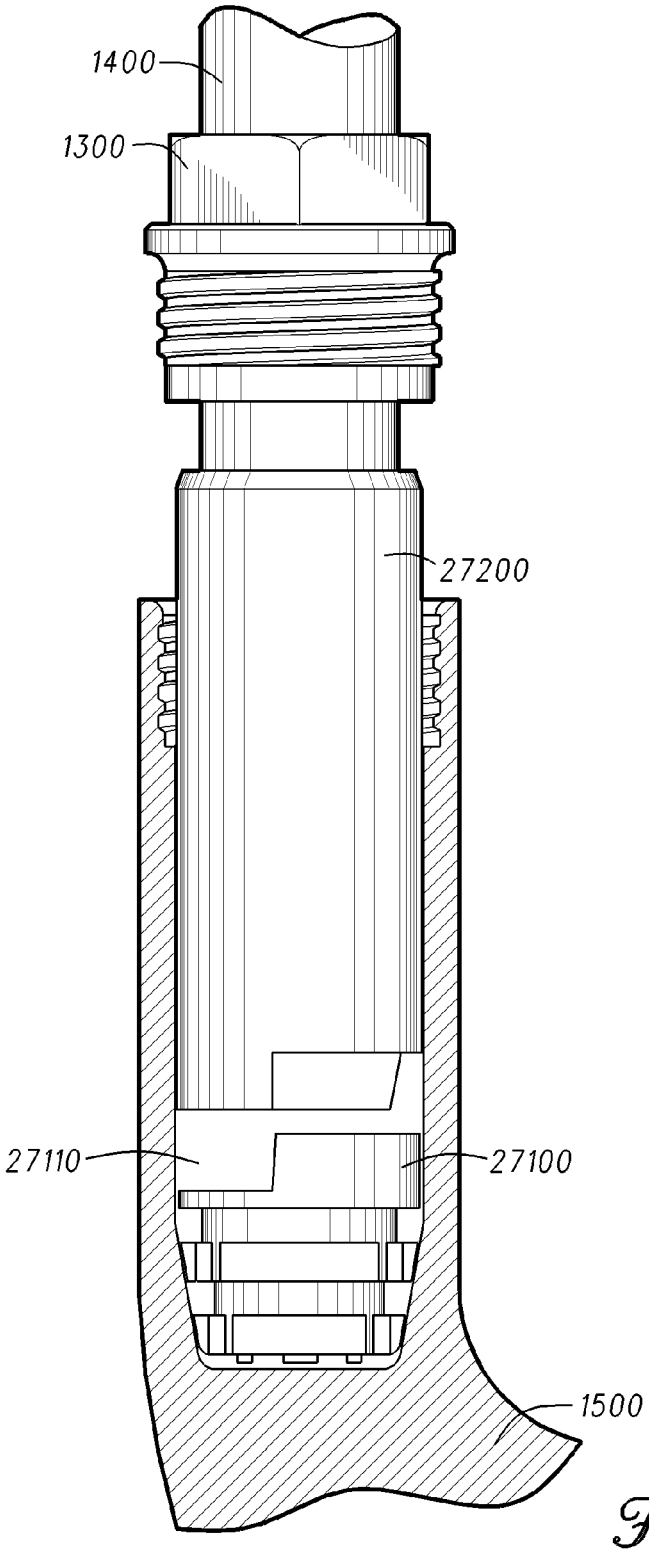
FIG. 27 illustrates a side view of a golf club attachment mechanism in a disengaged state, according to a fourth embodiment.
Figure 28:
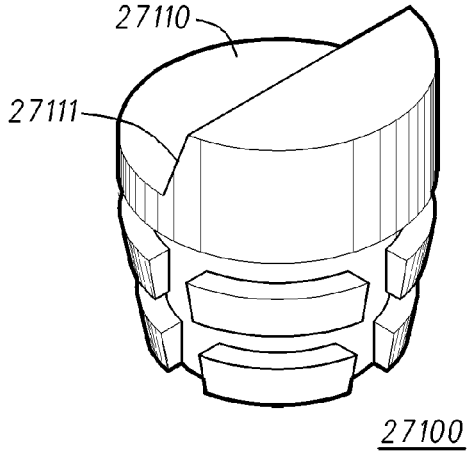
FIG. 28 illustrates a perspective view of a hosel adapter from the golf club attachment mechanism of FIG. 27.
Figure 29:
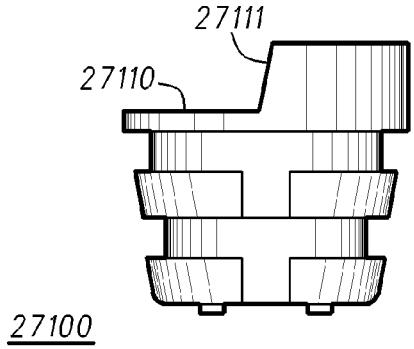
FIG. 29 illustrates a side view of the hosel adapter of FIG. 28.
Figure 31:
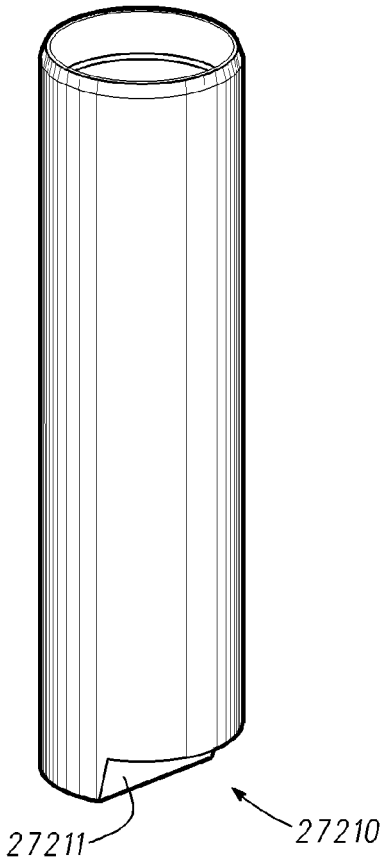
FIG. 31 illustrates a perspective view of a shaft adapter from the golf club attachment mechanism of FIG. 27.
Figure 30:
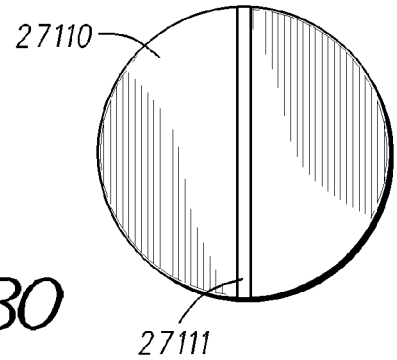
FIG. 30 illustrates a top view of the hosel adapter of FIG. 28.
Figure 33:
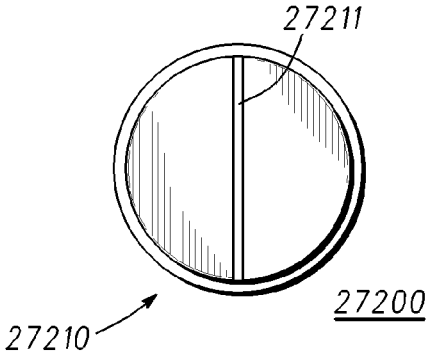
FIG. 33 illustrates a bottom view of the shaft adapter of FIG. 31.
Figure 32:
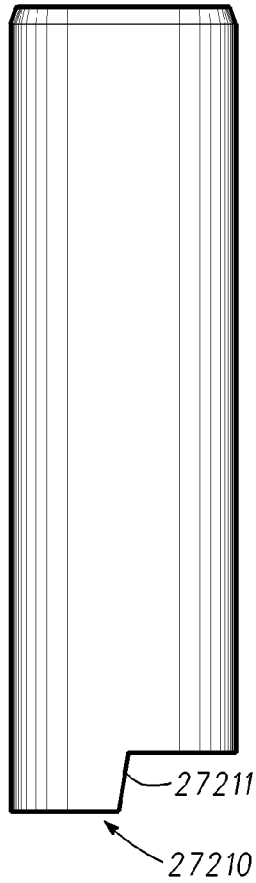
FIG. 32 illustrates a side view of the shaft adapter of FIG. 31.

Continuing with the Figures, FIG. 27 illustrates a side view of mechanism 27000 in a disengaged state. Mechanism 27000 includes hosel adapter 27100, shaft adapter 27200, and cap 1300, which are shown ready to be assembled to couple together golf club shaft 1400 and golf club head 1500. FIG. 28 illustrates a perspective view of hosel adapter 27100. FIG. 29 illustrates a side view of hosel adapter 27100. FIG. 30 illustrates a top view of hosel adapter 27100. FIG. 31 illustrates a perspective view of shaft adapter 27200. FIG. 32 illustrates a side view of shaft adapter 27200. FIG. 33 illustrates a top view of shaft adapter 27200.

Mechanism 27000 is similar to mechanisms 1000, 14000, and 23000 of FIGS. 1-26, respectively, serving similar purposes of coupling golf club heads and golf club shafts together at a predetermined desired orientation with respect to each other. Mechanism 27000 differs, however, with respect to the structure of slot coupler 27110 in hosel adapter 27100, and of slot coupler 27210 in shaft adapter 27200.

In the present example, as best illustrated in FIGS. 28-30, slot coupler 27110 of hosel adapter 27100 comprises a half-slot structure having surface 27111. The half-slot contrasts with the slot couplers of the hosel adapters in the mechanisms described above, which instead comprise a full slot having surfaces 1111 and 1112 opposite each other forming two separate walls of the full slot, as illustrated, for example, in FIGS. 2-4.

Similarly, as best illustrated in FIGS. 31-33, slot coupler 27210 of shaft adapter 2720 comprises a half-tab structure, having surface 27211, and being complementary to the half slot of slot coupler 27110. The half-tab contrasts with the slot couplers of the shaft adapters in the mechanisms described above, which instead comprise a full tab having surfaces 1211 and 1212 opposite each other forming two separate walls of the full tab, as illustrated, for example, in FIGS. 6-9. In some embodiments, the half-slot can be referred to as a half-tab. Similarly, the half-tab can be referred to as a half-protrusion.

In operation, notwithstanding structural differences, mechanism 27000 serves the same purposes of other mechanisms described above, where slot couplers 27110 and 27210 couple together to restrict a rotational movement of hosel adapter 27100 relative to shaft adapter 27200 via the complementary interaction of surfaces 27111 and 27211. Slot couplers 27100 and 27210 can have similar variations in one, two, or three dimensions from end to end, as described for the previous slot couplers.

Figure 37:
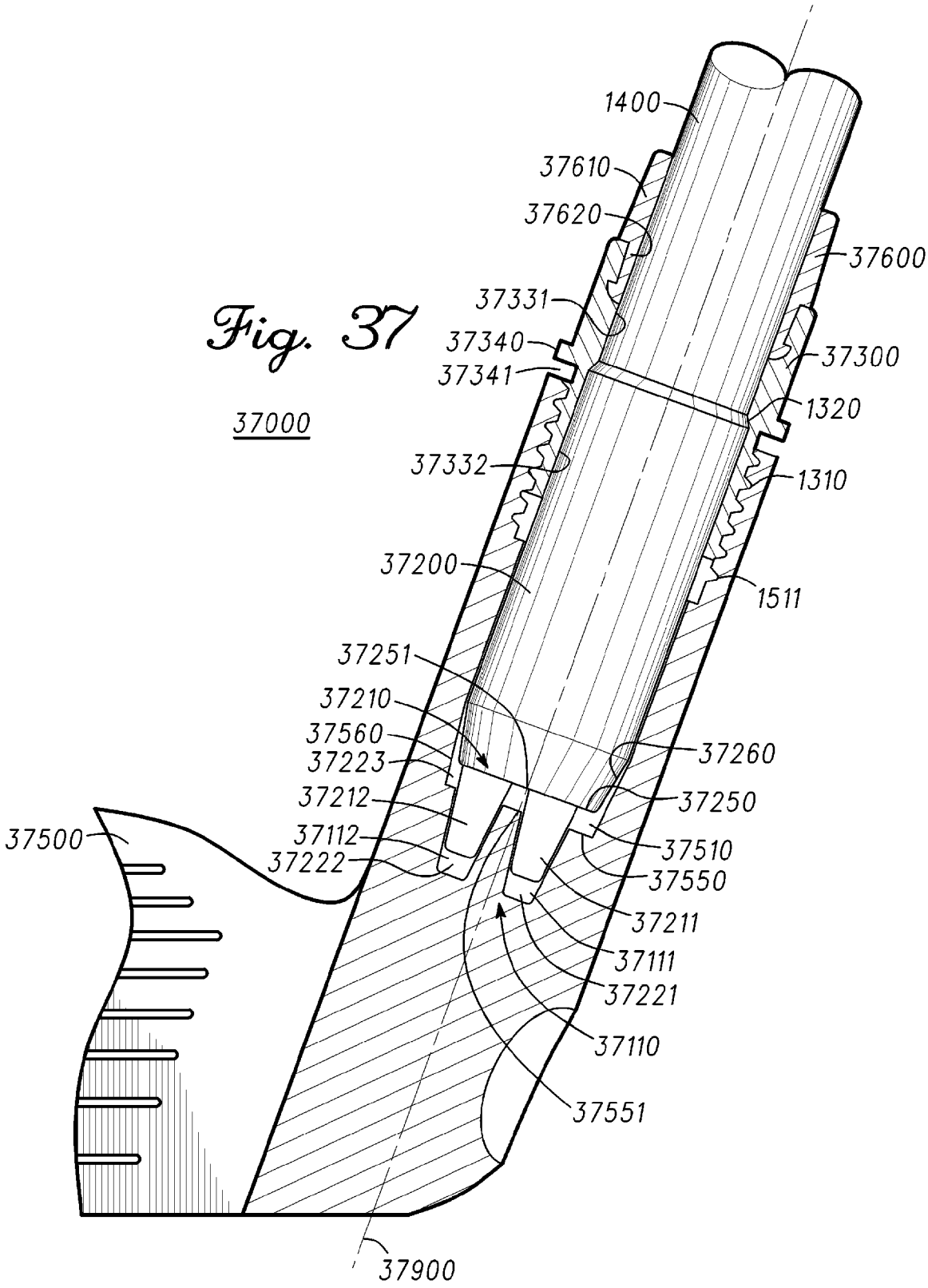
FIG. 37 illustrates a side view of a golf club attachment mechanism in an engaged state, according to a fifth embodiment.
Figure 38:
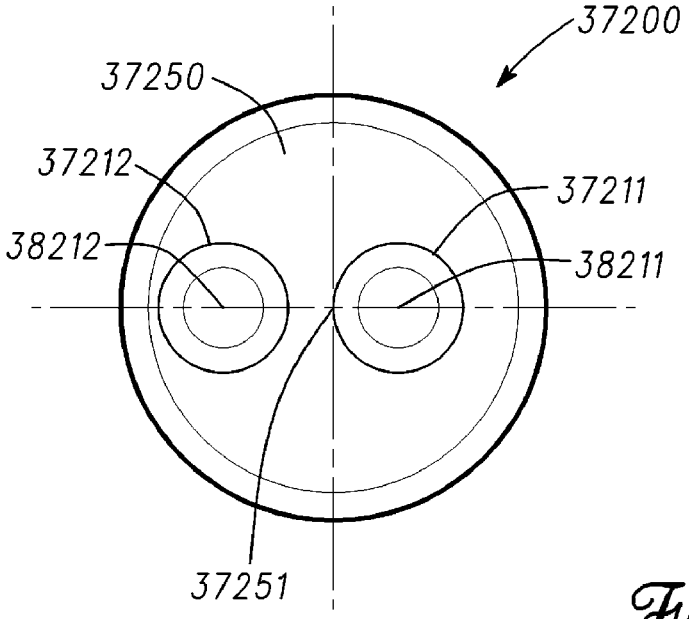
FIG. 38 shows a bottom view of a shaft adapter of the golf club attachment mechanism of FIG. 37.
Figure 39:
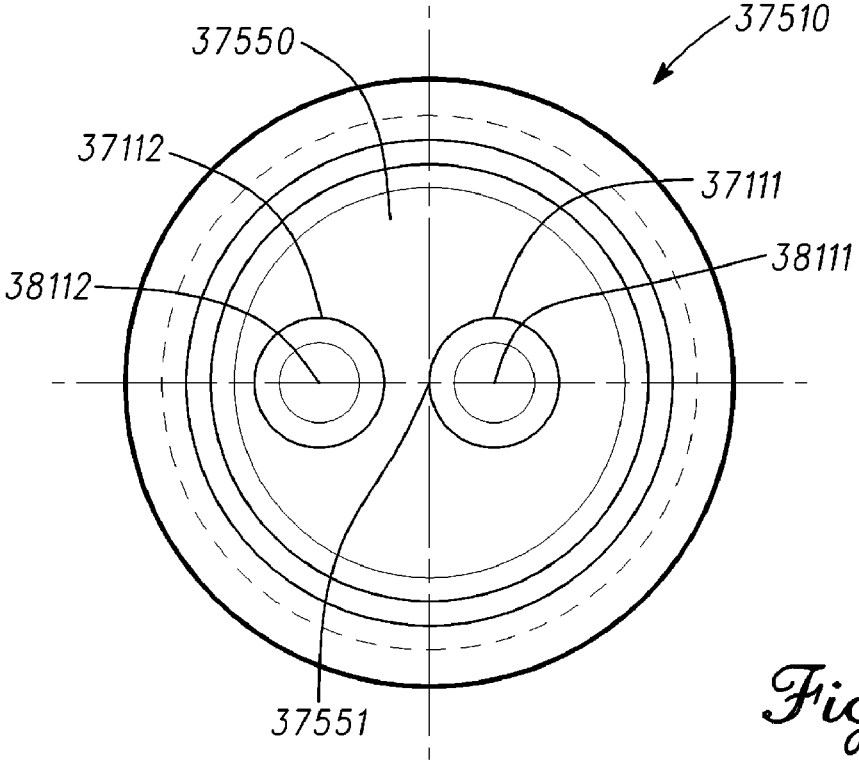
FIG. 39 shows a top view of a shaft receiver of a golf club head of the golf club attachment mechanism of FIG. 37.

Skipping ahead in the figures, FIG. 37 illustrates a side view of mechanism 37000 in an engaged state. Mechanism 37000 comprises shaft receiver 37510, shaft adapter 37200, and cap 37300, which are shown assembled and coupling together golf club shaft 1400 and golf club head 37500. In the present example, mechanism 37000 also comprises ferrule 37600 coupled to cap 37300, although other embodiments may omit ferrule 37600. A portion of golf club head 37500, cap 37300, and ferrule 37600 are shown in a cross-sectional view in FIG. 37. FIG. 38 shows a bottom view of shaft adapter 37200. FIG. 39 shows a top view of shaft receiver 37510.

Mechanism 37000 is similar to mechanisms 1000 (FIGS. 1, 24), 14000 (FIGS. 14, 25), 23000 (FIG. 23, 26) and/or 27000 (FIG. 27), serving similar purposes for coupling golf club heads and golf club shafts together at a predetermined desired orientation with respect to each other. Shaft adapter 37200 can be similar to shaft adapter 1200 (FIGS. 1, 6-9, 24), shaft adapter 14200 (FIGS. 14, 19-22, 25), shaft adapter 23200 (FIGS. 23, 26), and/or shaft adapter 27200 (FIGS. 27, 31-33) in some examples. In the same or other examples, cap 37300 can be similar to cap 1300 of mechanisms 1000, 14000, 23000, and/or 27000.

Mechanism 37000, however, comprises no separate adapter like hosel adapter 1100 (FIGS. 1-5, 24), hosel adapter 14100 (FIGS. 14-18, 25), hosel adapter 23100 (FIG. 23, 26), or hosel adapter 27100 (FIGS. 27-30). Instead, mechanism 37000 comprises coupler set 37110 integrated with shaft receiver 37510 at a bottom thereof. In some examples, coupler set 37110 can comprise slot couplers similar to slot coupler 1110 of hosel adapters 1100, 14100, and/or 23100, or slot coupler 27110 of hosel adapter 27100. Shaft receiver 37510 may be otherwise similar to hosel 1510 of mechanisms 1000 and 23000, hosel 14510 of mechanism 14000, or the hosel of mechanism 27000. In some examples, instead of comprising a hosel as shown in FIG. 37, shaft receiver 37510 may instead comprise a bore into a club head without an external cylindrical structure, where such club head can be otherwise similar to golf club head 37500.

In the present example, coupler set 37110 of shaft receiver 37510 comprises one or more female couplers, such as female couplers 37111 and 37112. Coupler set 37110 extends through surface 37550 of shaft receiver 37510, where surface 37550 comprises a bottom of shaft receiver 37510 in the present example. Correspondingly, shaft adapter 37200 comprises coupler set 37210 with one or more male couplers, such as male couplers 37211 and 37212. Coupler set 37210 protrudes from surface 37250 of shaft adapter 37200, where surface 37250 comprises a bottom of shaft adapter 37200 in the present example. As seen in FIG. 37, male coupler 37211 interlocks with female coupler 37111, and male coupler 37212 interlocks with female coupler 37112

As seen in FIG. 37, axis 37900 traverses mechanism 37000 through a center of shaft receiver 37510 and a center of shaft adapter 37200, passing through centerpoint 37551 of surface 37550 of shaft receiver 37510, and through centerpoint 37251 of surface 37250 of shaft adapter 37200. FIG. 39 shows how centerpoint 38112 of female coupler 37112 and centerpoint 38111 of female coupler 37111 are offset from centerpoint 37551 of shaft receiver 37510 at surface 37550. Similarly, FIG. 38 shows how centerpoint 38212 of male coupler 37212 and centerpoint 38211 of male coupler 38211 are offset from centerpoint 37251 of shaft adapter 37200 at surface 37250. Because of the offset, male couplers 37211 and 37212 can: (1) orient shaft adapter 37200 relative to shaft receiver 37510; and (2) restrict a rotational movement of shaft adapter 37200 relative to shaft receiver 37510 about axis 37900 when interlocked with female coupler 37112. In the present example, as seen in FIG. 38, a midpoint between male couplers 37211 and 37212 is offset from centerpoint 37251 at surface 37250 of shaft adapter 37200, and as seen in FIG. 39, a midpoint between female couplers 37111 and 37112 is also offset from centerpoint 37551 at surface 37550 of shaft receiver 37510.

As appreciated based on their respective locations on surfaces 37250 and 37550, male coupler 37211 and female coupler 37111 are configured to interlock together when male coupler 37212 is interlocked with female coupler 37112. When coupler set 37210 is interlocked with coupler set 37110 as described above, an orientation of shaft 1400 relative to golf club head 37500 can be thereby maintained. At least in part because of the offsetting described above, in the present example, male coupler 37211 is capable of interlocking with female coupler 37111 only when male coupler 37212 and female coupler 37112 also interlock together. As an example, in some embodiments, if centerpoint 38211 of male coupler 37211 were aligned with centerpoint 37112 of female coupler 37112 prior to interlocking, centerpoint 38212 of male coupler 37212 would not align with centerpoint 38111 of female coupler 37111, but would rather align to contact surface 37550 at a bottom of shaft receiver 37510, thereby preventing interlock between coupler sets 37110 and 37210.

In the present example, an outer wall of male coupler 37211 and an inner wall of female coupler 37111 comprise complementary taperings, such that the outer wall of male coupler 37211 can seat against the inner wall of female coupler 37111 to interlock male coupler 37211 in female coupler 37111. Also in the present example, an outer wall of male coupler 37212 and an inner wall of female coupler 37112 similarly comprise complementary taperings. In some examples, the tapering of male coupler 37211 can be configured to be incompatible with the tapering of female coupler 37112, thereby further restricting interlock between male coupler 37211 and female coupler 37112 because the outer wall of male coupler 37211 can not seat against the inner wall of female coupler 37112. There are other examples where a male coupler of coupler set 37210 and a female coupler of coupler set 37110 comprise constant diameters or perimeters with no tapering, yet interlock at an interface between their constant perimeters without seating against each other.

A length of male coupler 37211 can be shorter than a depth of female coupler 37110. In this embodiment, during interlocking, male coupler 37211 will not bottom out when inserted into female coupler 37110, thereby permitting the outer wall of male coupler 37211 to fully seat against the inner wall of female coupler 37110. Gap 37221 therefore lies between a bottom of male coupler 37211 and a bottom of female coupler 37111 after interlock. In the present example, gap 37221 is circumscribed by the tapering of female coupler 37111, which tapering continues past the bottom of male coupler 37211. A similar arrangement also applies in the present example with respect to gap 37222 between male coupler 37212 and female coupler 37112.

The present example illustrates that a gap 37223 can lie between surface 37250 of shaft adapter 37200 and surface 37550 of shaft receiver 37510 when coupler sets 37110 and 37210 are interlocked together. Such configuration can be achieved, as shown in FIG. 37, by configuring male couplers 37211 and/or 37212 such that a portion thereof protrudes over surface 37550 of shaft receiver 37510 to separate surface 37250 of shaft adapter 37200 from surface 37550 of shaft receiver 37510 when the outer walls of male couplers 37211 and/or 37212 are fully seated against the inner walls of female couplers 37111 and/or 37112. As result, surface 37250 of shaft adapter 37200 will not bottom out against surface 37550 of shaft receiver 37510 when coupler sets 37210 and 37110 to fully interlock together.

There can be some examples where an outer wall of shaft adapter 37200 can taper complementarily to an inner wall of shaft receiver 37510. In the present example of FIG. 37, wall portion 37260 of the outer wall of shaft adapter 37200 and wall portion 37560 of the inner wall of shaft receiver 37510 are both tapered, but wall portion 37260 is configured to taper away from wall portion 37560. As a result, wall portions 37260 and 37560 are not continuous with or parallel to each other when coupler sets 37110 and 37210 are interlocked together.

Continuing with FIG. 37, cap 37300 is shown coupled via cap fastener 1310 to hosel fastener 1511 at a top portion of shaft receiver 37510. Similar to cap 1300 (FIGS. 10-13), cap 37300 comprises inner perimeter 37331 to at least partially circumscribe an exterior perimeter of golf club shaft 1400. In the present example, cap 37300 also comprises inner perimeter 37332 (larger than inner perimeter 37331) to at least partially circumscribe an exterior perimeter of a top portion of shaft adapter 37200. In addition, cap flange 1320 is located in the present example between inner perimeters 37331 and 37332 of cap 37300. In some examples, a flange such as cap flange 1320 may be referred to as a lip. Other mechanisms similar to mechanism 37000 may comprise a cap similar to cap 37300, but where the cap flange instead comprises an end of the cap, and/or where the cap lacks a second inner perimeter, such that the cap couples to the top end of shaft adapter 37200 without partially circumscribing the top or narrower portion of shaft adapter 37200.

Cap 37300 is configured in the present example to push, via cap flange 1320, a top end of shaft adapter 37200 towards surface 37550 of shaft receiver 37510 when cap fastener 1310 is coupled to hosel fastener 1511. Such a configuration can serve to maintain the one or more male couplers of coupler set 37210 interlocked with the one or more female couplers of coupler set 37110. In the present and other embodiments, cap 37300 is capable of coupling over shaft adapter 37200 to the top portion of shaft receiver 37510 only when coupler sets 37110 and 37210 are interlocked together. In such embodiments, for example, if male coupler 37211 were misaligned away from female coupler 37111 and contacted surface 37550 of shaft receiver 37510 instead, the top portion of shaft adapter 37200 would be thereby elevated such that cap fastener 1310 could not reach and/or couple to hosel fastener 1511.

As seen in FIG. 37, cap 37300 also comprises external flange 37340 located at an exterior perimeter of cap 37300 such that gap 37341 can be maintained between external flange 37340 and a top end of shaft receiver 37510. The present configuration permits gap 37341 to be maintained when coupler sets 37110 and 37210 are interlocked together and cap 37300 is coupled to the top portion of shaft receiver 37510. In the same and other embodiments, gap 37341 is maintained even after hosel fastener 1511 and cap fastener 1310 are fully coupled together. Because of gap 37341, situations can be avoided where external flange 37340 bottoms out against the top end of shaft receiver 37510 before cap flange 1320 has sufficiently pushed shaft adapter 37200 into shaft receiver 37510 to secure the interlock between coupler sets 37110 and 37210.

In some examples, the gapping and tapering characteristics described above for mechanism 37000 can be useful for accommodating more relaxed manufacturing parameters while still to permitting full seating and secure interlocking of the one or more male couplers of coupler set 37210 against the one or more female couplers of coupler set 37110.

In the present example, mechanism 37000 also comprises ferrule 37600 coupled to cap 37300, where ferrule 37600 also comprises inner perimeter 37331 to at least partially circumscribe the exterior perimeter of golf club shaft 1400. As seen in FIG. 37, ferrule 37600 comprises portion 37610 located above a top end of cap 37300, and portion 37620 located between golf club shaft 1400 and a top portion of cap 37300. In the present and other embodiments, portion 37620 of ferrule 37600 can be useful for relieving, absorbing, or dissipating stresses between what would otherwise be a direct interface between the top end of cap 37300 and golf club shaft 1400, thereby protecting golf club shaft 1400 from damage as a result of such stresses.

In the present example, ferrule 37600 is coupled to cap 37300 via a barbed fastening mechanism, although other embodiments may comprise other fastening mechanisms comprising complementary screw threads, epoxy, and/or other suitable fasteners. Ferrule 37600 comprises a stress-dissipating material, where in the present example the stress-dissipating material of ferrule 37600 is softer than a material of cap 37300. In the same or other embodiments, the stress-dissipating material can be more flexible than the material of cap 37300. In the same or other embodiments, the material of cap 37300 can be at least one of harder, stiffer, or denser than the stress-dissipating material. There can be embodiments where the material of ferrule 37600 can comprise, for example, a thermoplastic material such as polyurethane, acrylonitrile butadiene styrene (ABS), and/or blends of the same or other thermoplastic materials. In the same or other embodiments, the material of ferrule 37600 can comprise a Prevail® 3150 material from The Dow Chemical Company, of Midland, Mich. Other types of materials may be suitable in other embodiments, including composite materials and/or metals such as aluminum, titanium, or steel. There can also be embodiments where the material of cap 37300 can comprise, for example, a metallic material or alloy such as steel and/or titanium.

There may be other mechanisms similar to mechanism 37000 with a ferrule that dispenses with portion 37610 and only comprises a portion between cap 37300 and golf club shaft 1400. In other embodiments, ferrule 37600 may be omitted entirely and/or may be an integral part of cap 37300.

Continuing with the figures, FIGS. 40-45 illustrate bottom views of shaft adapters suitable for use in mechanisms similar to mechanism 37000, where such mechanisms would also comprise shaft receivers (not shown) tailored to interlock with respective ones of the shaft adapters of FIGS. 40-45. If a portion of the shaft receivers are machined, the shaft receivers configured to interlock with the shaft adapters of FIGS. 37-38, 40, 41 and 42 might be easier to manufacture.

Figure 40:
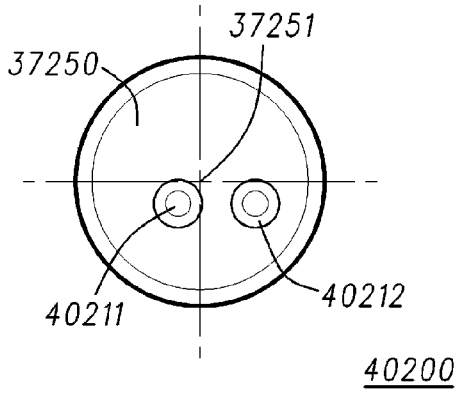
FIG. 40 illustrates a bottom view of a shaft adapter for a golf club attachment mechanism according to a sixth embodiment.

FIG. 40 illustrates a bottom view of shaft adapter 40200. Shaft adapter 40200 is similar to shaft adapter 37200 (FIG. 37-38), but comprises male couplers 40211 and 40212 with a different offset from centerpoint 37251 than male couplers 37211 and 37212 (FIG. 38).

Figure 41:
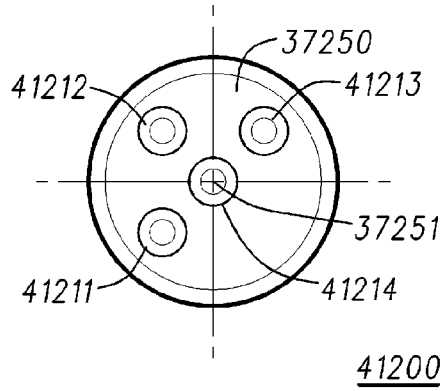
FIG. 41 illustrates a bottom view of a shaft adapter for a golf club attachment mechanism according to a seventh embodiment.

FIG. 41 illustrates a bottom view of shaft adapter 41200. Shaft adapter 41200 is similar to shaft adapter 37200 (FIG. 37-38), but comprises male couplers 41211-41214 instead of only two male couplers. In addition, male coupler 41214 is not offset from centerpoint 37251 in the present example.

Figure 42:
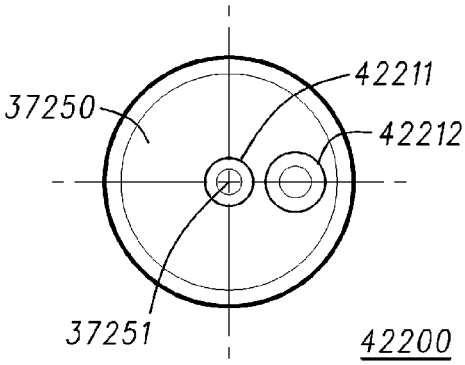
FIG. 42 illustrates a bottom view of a shaft adapter for a golf club attachment mechanism according to a eight embodiment.

FIG. 42 illustrates a bottom view of shaft adapter 42200. Shaft adapter 42200 is similar to shaft adapter 37200 (FIG. 37-38), but comprises male couplers 42211-42212. Male coupler 42211 is not offset form centerpoint 37251, unlike male coupler 37211 of shaft adapter 37200 (FIG. 38). In addition, male coupler 42212 is larger than male coupler 42211, unlike male couplers 37211-37212 of shaft adapter 37200 (FIG. 38), which are shown as comprising the same size.

Figure 43:
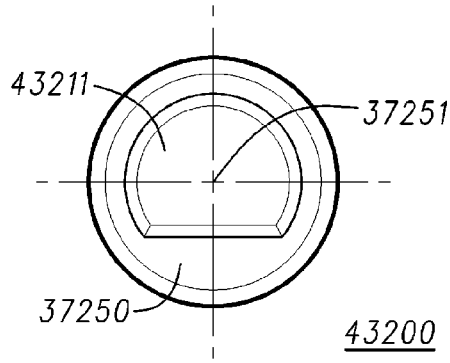
FIG. 43 illustrates a bottom view of a shaft adapter for a golf club attachment mechanism according to a ninth embodiment.

FIG. 43 illustrates a bottom view of shaft adapter 43200. Shaft adapter 43200 is similar to shaft adapter 37200 (FIG. 37-38), but comprises single male coupler 43211 in a partial circular shape. A center of the circle circumscribing male coupler 43211 is not offset from centerpoint 37251 but a center of male coupler 43211 is offset from centerpoint 37251.

Figure 44:
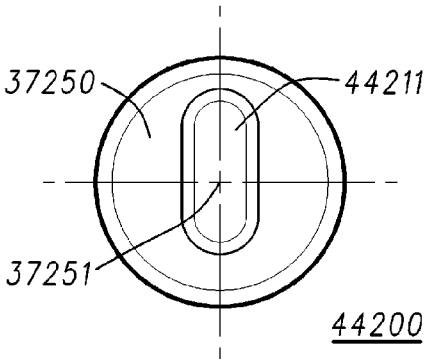
FIG. 44 illustrates a bottom view of a shaft adapter for a golf club attachment mechanism according to a tenth embodiment.

FIG. 44 illustrates a bottom view of shaft adapter 44200. Shaft adapter 44200 is similar to shaft adapter 37200 (FIG. 37-38), but comprises single male coupler 44211 in an oval-like shape. Male coupler 44211 is also offset from centerpoint 37251.

Figure 45:
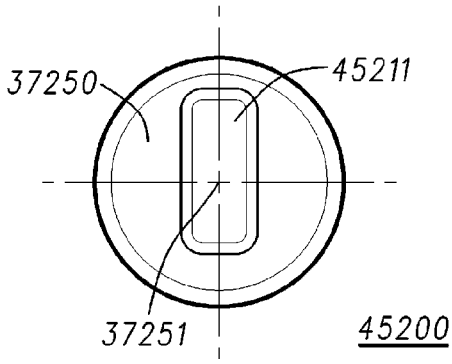
FIG. 45 illustrates a bottom view of a shaft adapter for a golf club attachment mechanism according to a eleventh embodiment.

FIG. 45 illustrates a bottom view of shaft adapter 45200. Shaft adapter 45200 is similar to shaft adapter 37200 (FIG. 37-38), but comprises single male coupler 45211 in a substantially rectangular shape. Male coupler 45211 is also offset from centerpoint 37251.

Despite the differences described above for shaft adapters 40200, 41200, 42200, 43200, 44200, and 45200 relative to shaft adapter 37200, mechanisms tailored for shaft adapters 40200, 41200, 42200, 43200, 44200, and 45200 can also comprise the same or similar gapping and/or tapering characteristics described above for mechanism 37000, including gaps similar to gaps 37221, 37222, 37223, and 37341.

Figure 34:
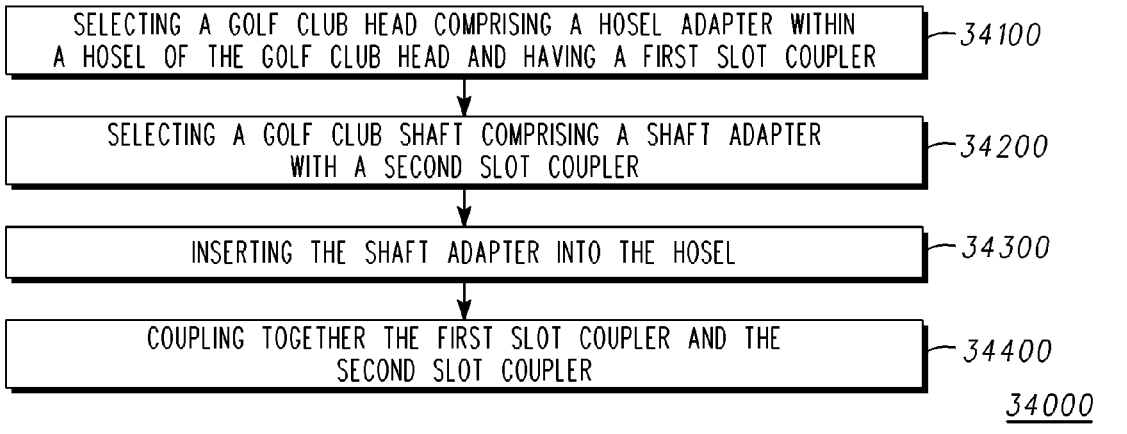
FIG. 34 illustrates a flowchart of method for operating a golf club attachment mechanism, according to an embodiment.

Backtracking through the figures, FIG. 34 illustrates a flowchart of method 34000 for operating a golf club attachment mechanism. As an example, the golf club attachment mechanism in method 34000 can be mechanism 1000 in FIG. 1, mechanism 14000 in FIG. 14, mechanism 23000 in FIG. 23, and mechanism 27000 in FIG. 27.

Block 34100 of method 34000 involves selecting a golf club head comprising a hosel adapter within a hosel of the golf club head and having a first slot coupler. In one embodiment, the first slot coupler of the hosel adapter of block 34100 can be similar to slot coupler 1110 of mechanism 1000 in FIG. 1, or any other similar slot coupler for the other golf club attachment mechanisms described above. In one example, part of block 34100 can comprise attaching the hosel adapter to a bottom of the hosel, such as described for hosel adapter 1100 (FIG. 1) being attached to hosel 1510 (FIG. 1).

Block 34200 of method 34000 involves selecting a golf club shaft comprising a shaft adapter with a second slot coupler. In one embodiment, the second slot coupler of the shaft adapter of block 34200 can be similar to slot coupler 1210 of mechanism 1000 in FIG. 1, or any other similar slot coupler for the other golf club attachment mechanisms described above. In one example, part of block 34200 can comprise attaching the shaft adapter to an end of the golf club shaft, such as described for shaft adapter 1200 (FIG. 1) being attached to an end of golf club shaft 1400 (FIG. 1).

Block 34300 of method 34000 involves inserting the shaft adapter of block 34200 into the hosel of block 34100. As an example, the shaft adapter can be inserted into the hosel as illustrated for FIG. 1, where shaft adapter 1200, being complementary to the interior of hosel 1510, traverses the interior length or depth of hosel 1510 until slot coupler 1210 of shaft adapter 1200 contacts slot coupler 1110 of hosel adapter 1100.

Block 34400 of method 34000 comprises coupling together the first slot coupler of block 34100 and the second slot coupler of block 34200. Block 34400 can be accomplished as illustrated for slot couplers 1110 and 1210 of mechanism 1000 in FIG. 1, or for any similar slot couplers of any of the golf club attachment mechanisms described above. In some examples, block 34400 can involve one or more sub-blocks, as described below for method 35000.

Figure 35:
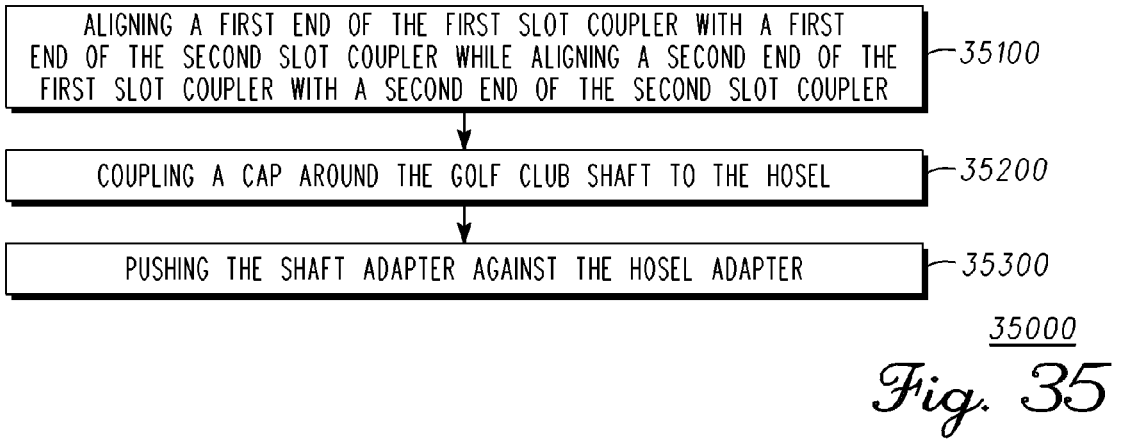
FIG. 35 illustrates a method for coupling together a first slot coupler and a second slot coupler of a golf club attachment mechanism, according to another embodiment.

FIG. 35 illustrates a method 35000 for coupling together a first slot coupler and a second slot coupler of a golf club attachment mechanism. In one example, the first and second slot couplers of method 35000 can be the first and second slot couplers of block 34400 as described for method 34000 (FIG. 34), including the respective slot coupler pairs for mechanism 1000 of FIG. 1, mechanism 1400 of FIG. 14, mechanism 2100 of FIG. 21, and mechanism 27000 of FIG. 27.

Block 35100 of method 35000 involves aligning a first end of the first slot coupler with a first end of the second slot coupler, and aligning a second end of the first slot coupler with a second end of the second slot coupler. Block 35100 can also be divided into two separate blades, each comprising a different one of the aligning processes. In one embodiment, the first end and the second end of the first slot coupler can be similar to end 1114 and end 1113, respectively, of slot coupler 1110 as illustrated for mechanism 1000 in FIG. 4. In the same or a different embodiment, the first end and the second end of the second slot coupler can be similar to end 1214 and end 1213, respectively, of slot coupler 1210 as illustrated for mechanism 1000 in FIG. 9.

In some embodiments, the dimensions of the different slot couplers in block 35100 are designed such that only the first end of the first slot coupler could engage with the first end of the second slot coupler, and such that only the second end of the first slot coupler could engage with the second end of the second slot coupler. In one such embodiment, the first ends of the first and second slot couplers are narrower than the second ends of the first and second slot couplers. For example, as illustrated in FIG. 4 for slot coupler 1110 of mechanism 1000, end 1114 is narrower than end 1113. Similarly, as illustrated in FIG. 9 for slot coupler 1210 of mechanism 1000, end 1214 is complementary with end 1114 (FIG. 4), incompatible with end 1113 (FIG. 4), and narrower than end 1213. In this embodiment, end 1213 is complementary instead with end 1113 (FIG. 4) and incompatible with end 1114 (FIG. 4).

Block 35200 of method 35000 involves coupling a cap around the golf club shaft to the hosel. In one embodiment, the cap can be similar to cap 1300 of FIGS. 10-13, as used, for example, by mechanism 1000 or any other mechanism described above. In one example, block 35200 can be carried out as illustrated for mechanism 1000 in FIG. 1, coupling cap 1300 around golf club shaft 1400 to hosel 1510, after the slot couplers 1110 and 1210 are aligned as described, for example, in block 35100. After being coupled to the hosel, the cap inhibits the different parts of golf club attachment mechanism from becoming disengaged.

Block 35300 of method 35000 involves pushing the shaft adapter against the hosel adapter. In one example, pushing the shaft adapter against the hosel adapter allows the slot couplers, once aligned per block 35100, to engage such that they cannot rotate relative to each other. In the same or a different example, the cap of block 35200 pushes the shaft adapter against the hosel adapter, as required by block 35300, while the cap is coupled to the hosel per block 35200.

In one embodiment, blocks 34100, 34200, 34300 and 34400 of method 34000 can be subparts of a single block, and/or their sequence can be otherwise changed. Similarly, in the same or a different embodiment, blocks 35100, 35200, and 35300 of method 35000 can be parts of a single block, and/or their sequence can be otherwise changed. In addition, method 35000 can be a subpart of method 34000. Also, methods 34000 and 35000 can be used for hosel-less golf club heads.

Figure 36:
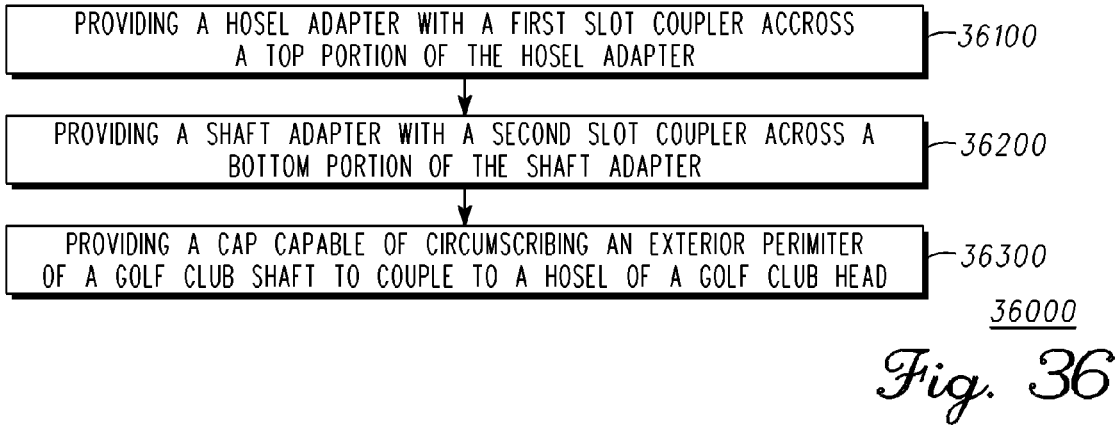
FIG. 36 illustrates a flowchart of method for manufacturing a golf club attachment mechanism, according to a further embodiment.

Continuing with the figures, FIG. 36 illustrates a flowchart of method 36000 for manufacturing a golf club attachment mechanism. As an example, the golf club attachment mechanism in method 36000 can be mechanism 1000 in FIG. 1, mechanism 1400 in FIG. 14, mechanism 2300 in FIG. 23, and mechanism 27000 in FIG. 27.

For method 36000, manufacturing the golf club attachment mechanism can comprise making the golf club attachment mechanism available to purchasers or users, for example, by the manufacturer of the golf club, distributors, marketers, or resellers. The golf club attachment mechanism can be made available via wholesale distribution methods, and/or through retail networks that cater to midstream parties or end users.

Block 36100 of method 36000 involves providing a hosel adapter with a first slot coupler across a top portion of the hosel adapter. As an example, the hosel adapter can be hosel adapter 1100 of mechanism 1000 as shown in FIGS. 1-5, or a similar hosel adapter from any of the mechanisms described above. In one embodiment, the first slot coupler can comprise a slot or a trench. In the same or a different embodiment, the first slot coupler can comprise a tab or a protrusion. In the same or a different embodiment, the first slot coupler can comprise a half-slot or a half-tab as illustrated for mechanism 27000 in FIG. 27.

In one example, block 36100 of method 36000 can comprise coupling the hosel adapter with a hosel of a golf club head. Such coupling can be accomplished, for example, as described for hosel adapter 1100 in FIG. 1, using epoxy or other suitable adhesives to adhere the hosel adapter to the bottom of the hosel. In some embodiments, the adhesion of the hosel adapter to the hosel via the adhesive can be enhanced by providing grooves at the perimeter of the hosel adapter, such as grooves 1130 and 1140 of hosel adapter 1100 in FIGS. 1-3.

In the same or a different example, block 36100 of method 36000 can comprise manufacturing the first slot coupler to taper from a first end to a second end narrower than the first end of the first slot coupler. As an example, the first end of the first slot coupler can be end 1114, and the second end of the first slot coupler can be end 1113, as illustrated for hosel adapter 1100 of mechanism 1000 in FIG. 4.

Block 36200 of method 36000 involves providing a shaft adapter with a second slot coupler complementary to the first slot coupler across a bottom portion of the shaft adapter. As an example, the shaft adapter can be shaft adapter 1200 of mechanism 1000 as shown in FIGS. 1 and 6-9, or a similar shaft adapter from any of the mechanisms described above. In one embodiment, the second slot coupler can comprise a slot or a trench. In the same or a different embodiment, the second slot coupler can comprise a tab or a protrusion. In the same or a different embodiment, the second slot coupler can comprise a half-slot or a half-tab as illustrated for mechanism 27000 in FIG. 27.

In one example, block 36200 of method 36000 can comprise coupling the shaft adapter with an end of a golf club shaft. Such coupling can be accomplished, for example, as described for shaft adapter 1200 in FIG. 1. In one embodiment, the shaft adapter can comprise a bore to couple around an exterior perimeter of the end of the golf club shaft. In a different embodiment, the shaft adapter can comprise a rod to couple within an interior perimeter of the end of the golf club shaft. The coupling can be secured using adhesives like epoxy, or other mechanical fasteners such as screws.

In the same or a different example, block 36200 of method 36000 can comprise manufacturing the second slot coupler to taper from a first end to a second end narrower than the first end of the second slot coupler and complementary to the first slot coupler. As an example, the first end of the second slot coupler can be end 1214, and the second end of the second slot coupler can be end 1213, as illustrated for shaft adapter 12000 of mechanism 1000 in FIG. 9.

As illustrated, for example, in FIGS. 24-26 for mechanisms 1000, 14000, and 23000, respectively, the first and second slot couplers 1110 and 1210 couple together to inhibit a rotational movement of the hosel adapter of block 36100 relative to the shaft adapter of block 36200. In the same or a different embodiment, when coupled together, the first and second slot couplers maintain an alignment of the golf club shaft and the golf club head relative to each other. This alignment may be predetermined or pre-designed. For example, the golf club shaft can be manufactured or designed to limit flexing to be along a flex plane relative to a swing path of the golf club shaft, or at one or more regions of the golf club shaft. In such cases, the first and second slot couplers can be attached and oriented relative to the golf club head and golf club shaft, respectively, keeping the flex plane and/or regions of the golf club shaft in mind. When the first and second slot couplers are coupled together, the golf club head will be automatically aligned relative to the golf club shaft such that the golf club shaft will be able to flex substantially along the predetermined flex plane when swung to strike the golf ball.

Block 36300 of method 36000 involves providing a cap capable of circumscribing an exterior perimeter of a golf club shaft to couple to a hosel of a golf club head. As an example, the cap of block 36300 can be cap 1300, as illustrated in FIGS. 10-13, used by mechanism 1000 in FIGS. 1 and 24, or by other similar mechanisms described above. In one example, the cap can couple to the hosel via complementary screw threads on both the cap and the top of the hosel.

When coupled to the hosel, the cap maintains the shaft adapter of block 36200 in a position within the hosel of the golf club head while pushing the shaft adapter against the hosel adapter of block 36200. In the same or a different example, the cap comprises a flange to push the shaft adapter, or the cap can push the shaft adapter with a bottom of the cap. The cap can thus secure the coupling between the first and second slot couplers of blocks 36100 and 36200, respectively, as illustrated, for example, in FIGS. 24-26 for the different mechanisms described above. This prevents the golf club attachment mechanism from becoming disengaged.

In one embodiment, blocks 36100, 36200, and 36300 of method 36000 can be subparts of a single block. In the same or a different embodiment, the sequence of blocks 36100, 36200, and 36300 of method 36000 can be otherwise changed. Also, method 36000 can be used for hosel-less golf club heads.

Figure 46:
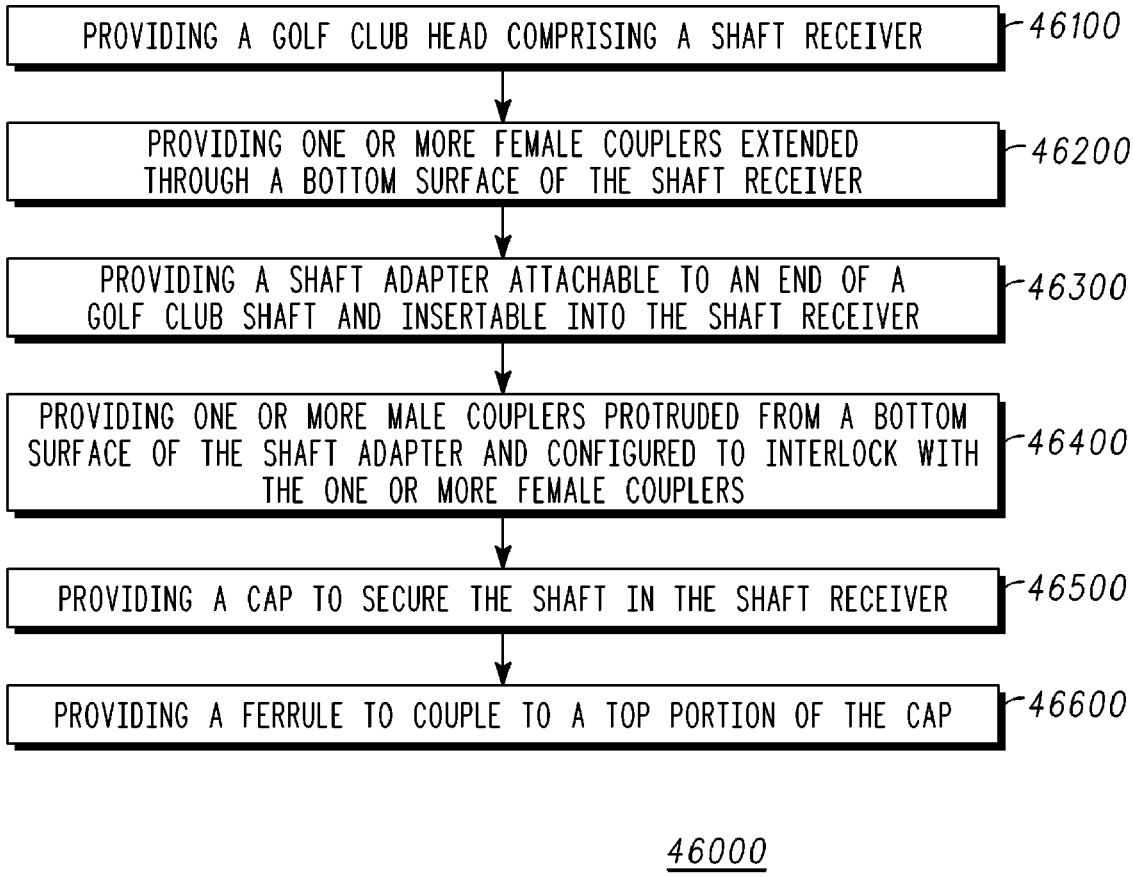
FIG. 46 illustrates a flowchart of a method for providing a golf club attachment mechanism.

Skipping ahead in the figures, FIG. 46 illustrates a flowchart of method 46000 for providing a golf club attachment mechanism. As an example, the golf club attachment mechanism in method 46000 can be mechanism 37000 (FIGS. 37-39) or the mechanisms described above with respect to FIGS. 40-45.

Block 46100 of method 46000 involves providing a golf club head comprising a shaft receiver. As an example, the golf club head can be similar to golf club head 37500 (FIG. 37), and the shaft receiver can be similar to shaft receiver 37510 (FIG. 37).

Block 46200 of method 46000 comprises providing one or more female couplers extended through a bottom surface of the shaft receiver of block 46100. In some examples, the one or more female couplers can be similar to the one more female couplers of coupler set 37110, such as female couplers 37111 and 37112 (FIGS. 37, 39). In other examples, the female couplers can be similar to the female couplers corresponding to shaft adapters 40200, 41200, 42200, 43200, 44200, or 45200 of FIGS. 40-45, and/or to slot couplers 1110 (FIG. 1) or 27110 (FIG. 27).

Block 46300 of method 46000 comprises providing a shaft adapter attachable to an end of a golf club shaft and insertable into the shaft receiver of block 46100. In some examples, the shaft adapter of block 46300 can be similar to shaft adapter 37200 (FIGS. 37-38). In other examples, the shaft adapter can be similar to shaft adapters 40200, 41200, 42200, 43200, 44200, or 45200 (FIGS. 40-45), and/or shaft adapters 1200 (FIG. 1), 14200 (FIG. 14), 23200 (FIG. 23) or 27200 (FIG. 27).

Block 46400 of method 46000 comprises providing one or more male couplers protruded from a bottom surface of the shaft adapter and configured to interlock with the one or more female couplers of block 46200. In some examples, the one or more male couplers of block 46400 can be similar to the one or more male couplers of coupler set 37210, such as male couplers 37211 and 37212 (FIGS. 37-38). In other examples, the male couplers can be similar to the male couplers of shaft adapters 40200, 41200, 42200, 43200, 44200, or 45200 of FIGS. 40-45, and/or to slot couplers 1210 (FIG. 1) or 27210 (FIG. 27).

Block 46400 can comprise several sub-blocks. For example, block 46400 can comprise locating a first male coupler of the one or more male couplers at a first distance from a centerpoint of the bottom surface of the shaft adapter. The first male coupler of the one or more male couplers can be provided to interlock with a first female coupler of the one or more female couplers of block 46200. In some embodiments, the first male and female couplers interlock when an outer wall of the first male coupler seats against an inner wall of the first female coupler. In some examples, the centerpoint of the bottom surface of the shaft adapter can be similar to centerpoint 37251 (FIGS. 37-38), and the first male coupler can be similar to male coupler 37211 of coupler set 37210, separated from centerpoint 37251 as shown in FIGS. 37-38. The first female coupler can be similar to female coupler 37111 of coupler set 37110 in the same or other examples. In other examples, where the first male coupler is at the centerpoint, the first distance can be zero. There can be examples where the interlock of the first male and female couplers is facilitated by complementary taperings, as described above for the seating between the outer wall of male coupler 37211 and the inner wall of male coupler 37111 (FIGS. 37-39).

Block 46400 can also comprise locating a second male coupler of the one or more male couplers at a second distance from the centerpoint of the bottom surface of the shaft adapter. The second male coupler of the one or more male couplers can be provided to interlock with a second female coupler of the one or more female couplers of block 46200. In some examples, the second male coupler can be similar to male coupler 37212 separated from centerpoint 37251 as shown in FIGS. 37-38. The second female coupler can be similar to female coupler 37112 of coupler set 37110 in the same or other examples. There can be examples where the second distance can be greater than the first distance, or vice version. When interlocked with a corresponding one of the one or more female couplers, at least one of the one or more male couplers maintains an orientation of the club head of block 46100 relative to the shaft adapter of block 46300.

In at least some examples, block 46400 can involve locating the first male coupler to be misaligned with the first female coupler when the second male coupler is misaligned with the second female coupler. For example, if the first male coupler were aligned with the second female coupler instead of with the first female coupler, the second male coupler would then be aligned with, for example, the bottom surface of the shaft receiver of block 46100 rather than with the second female coupler. Such a configuration would prevent misalignment of the golf club head of block 46100 with the golf club shaft of block 46300.

There can be instances of block 46400 where, for example, the first female coupler comprises a gap between a bottom of the first male coupler and a bottom of the first female coupler when the male and female couplers are interlocked and/or when the outer wall of the first male coupler is seated against the inner wall of the first female coupler. As an example, such gap can be similar to one of gaps 37221 or 37222, as illustrated and described above for FIG. 37. The gap can exist even when the first male coupler is fully seated against the first female coupler.

Continuing with method 46000, block 46500 comprises providing a cap to secure the shaft adapter of block 46300 in the shaft receiver of block 46100. In some examples, the cap of method 46000 can be similar to cap 37300, as described with respect to FIG. 37. Providing the cap in block 46500 can comprise providing a fastener at a bottom portion of the cap to couple with a fastener at a top portion of the shaft receiver of block 46100. In some examples, the fastener of the cap can be similar to cap fastener 1310, and the fastener of the shaft receiver can be similar to hosel fastener 1511, as illustrated in FIG. 37. Providing the cap in block 46500 can also comprise providing a first inner perimeter of the cap to circumscribe an exterior perimeter of the club shaft, where the first inner perimeter of the cap can be similar to inner perimeter 37331 of cap 37300 (FIG. 37). In the same and other embodiments, providing the cap of block 46500 can further comprise providing a second inner perimeter of the cap to circumscribe a top portion of the shaft adapter of block 46300, where the second inner perimeter of the cap can be similar to inner perimeter 37332 of cap 37300 (FIG. 37). In embodiments where the cap of block 46500 comprises both the first and second inner perimeters; providing the cap can further comprise locating a flange between the first and second inner perimeter of the cap, where the flange can be similar to cap flange 1320 of cap 37300 (FIG. 37). In other embodiments, such as embodiments not comprising the second inner perimeter, the flange of the cap of block 47500 can comprise a top or bottom end of the cap.

The flange of the cap of block 46500 can be configured to push against a top of the shaft adapter of block 46300 towards the bottom surface of the shaft receiver of block 46100, as the first and second fasteners of the shaft receiver and the cap couple together, when the one or more male couplers of block 46400 are interlocked with the two or more female couplers of block 46200. Such a configuration can permit the interlock between the male and female couplers of the shaft adapter and the shaft receiver to be secured, as described above for FIG. 37 with respect to cap 37300 securing shaft adapter 37200 in shaft receiver 37510.

There can also be embodiments where block 46500 further comprises locating an external flange at an exterior of the cap to permit a gap between the external flange of the cap and a top end of the shaft receiver of block 46100 when the first and second fasteners are coupled together and the male couplers of the shaft adapter are secured in the female couplers of the shaft receiver. In the same or other examples, the gap remains even after the first and second fasteners are fully coupled together. In some examples, the external flange of the cap can be similar to external flange 37340 of cap 37300, and the gap can be similar to gap 37341 (FIG. 37).

Method 46000 continues with block 46600, which comprises providing a ferrule to couple to a top portion of the cap of block 46500. In some embodiments, block 46600 can comprise providing a material of the ferrule to be more flexible and/or softer than a material of the cap. There can be examples where the ferrule of block 46600 is similar to ferrule 37600, and/or made out of the same material as ferrule 37600. The ferrule of method 46000 can comprise an inner perimeter to circumscribe the exterior perimeter of the golf club shaft described for block 46200. In the same and other embodiments, the inner perimeter of the ferrule can be similar to or the same as the first inner perimeter of the cap of block 46500. Providing the ferrule in block 46600 can also comprise providing a portion of the ferrule, which can be similar to portion 37620 of ferrule 37600 (FIG. 37), to lie between the exterior perimeter of the golf club shaft and the top portion of the cap of block 46500.

There can be different types of manufacturing processes that could be suitable for some of the blocks of method 46000. For example, providing the two or more female couplers in block 46200 can be achieved by machining the two or more female couplers into the bottom surface of the shaft receiver. Other mechanisms for providing the two or more female couplers in block 46200 can comprise forgoing or casting. There can also be examples of method 46000 where providing the two or more male couplers in block 46400 can comprise one or more of forging, casting, or machining the two or more male couplers at the bottom surface of the shaft adapter. There can be embodiments machining in blocks 46200 and/or 46400 can comprise, for example, drilling and/or Electrical Discharge Machining (EDM).

In some examples, one or more of the different blocks of method 46000 can be combined into a single block or performed simultaneously, and/or the sequence of such blocks can be changed. For example, blocks 46100 and 46200 can be combined into a single block in some embodiments, and blocks 46300 and 46400 can be combined into a single block in the same or other embodiments, and/or blocks 46500 and 46600 can be combined into a single block. In the same or other examples, some of the blocks of method 46000 can be subdivided into several sub-blocks. For example, providing the golf club head in block 46100 may comprise further sub-blocks such as forming a strike face of the golf club head. There can also be examples where method 46000 can comprise further or different blocks. As an example, method 46000 can also comprise providing a second golf club head compatible with the shaft adapter of block 46300, and/or providing a second golf club shaft attached to a second shaft adapter compatible with the shaft receiver of block 46100. Method 46000 can also comprise optional blocks in some implementations. For example, block 46600 can be optional such that the ferrule can be omitted in some embodiments. Other variations can be implemented for method 46000 without departing from the scope of the present disclosure.

Although the golf club attachment mechanism and related methods have been described with reference to specific embodiments, various changes may be made without departing from the spirit or scope of the golf club attachment mechanism and related methods. Various examples of such changes have been given in the foregoing description. Accordingly, the disclosure of embodiments of the golf club attachment mechanism and related methods is intended to be illustrative of the scope of the application and is not intended to be limiting. It is intended that the scope of this application shall be limited only to the extent required by the appended claims. For example, it will be readily apparent that the golf club attachment mechanism and related methods discussed herein may be implemented in a variety of embodiments, and that the foregoing discussion of certain of these embodiments does not necessarily represent a complete description of all possible embodiments.

As a specific example, although the figures illustrate slot couplers as slots, tabs, protrusions and/or trenches of a certain complementary shape, such shape is exemplary and does not limit other embodiments from using other complementary geometries, such as ovals, triangles, pentagons, trapezoids, or the like, capable of providing functionality similar to that described above for slot couplers 1110 and 1210.

In another example, the methods, apparatus, and/or articles of manufacture described herein may not include a separate hosel adapter, or the hosel adapter may be integral to a shaft receiver of the golf club head. In some embodiments, the shaft receiver can be referred to as a hosel. Referring back to FIG. 1, for example, slot coupler 1110 of hosel adapter 1100 may be an integral portion of golf club head 1500. That is, slot coupler 1110 may be formed across an inner bottom surface of a shaft receiver, such as hosel 1510, via a machine (e.g., cut, drilled, etc.). Alternatively, slot coupler 1110 may be cast as a portion of golf club head 1500 across a bottom of the shaft receiver. Accordingly, shaft adapter 1200 may engage directly with golf club head 1500. A similar implementation can be had for a hosel-less golf club head where the shaft receiver comprises a cavity, instead of a hosel, to receive shaft adapter 1200. In such an example, slot coupler 1110 may also be formed across an inner bottom surface of the shaft receiver via a machine or cast as a portion of the hosel-less golf club head.

Although certain examples have been described above, other suitable methods may be used to form a slot coupler as an integral portion of a golf club head.

There can also be embodiments where the gender of the couplers described herein can be altered or swapped. As an example, although coupler set 37111 is illustrated in FIG. 37 as comprising only female couplers, there can be embodiments where one or more of the couplers of coupler set 37111 can be male instead. In such embodiments, the gender of corresponding couplers in coupler set 37210 (FIG. 37) would also be swapped to permit proper interlocking between corresponding male and female couplers.

In light of the above, the detailed description of the drawings, and the drawings themselves, disclose at least one preferred embodiment of the golf club attachment mechanism and related methods, and may disclose alternative embodiments of the golf club attachment mechanism and related methods.

All elements claimed in any particular claim are essential to the golf club attachment mechanism or related methods claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club mechanism comprising:

a first first-type coupler of one or more first-type couplers at a bottom surface of a shaft receiver of a club head;

a first second-type coupler of one or more second-type couplers at a bottom surface of a shaft adapter;

a second first-type coupler of the one or more first-type couplers at the bottom surface of the shaft receiver of the club head; and a second second-type coupler of the one or more second-type couplers at the bottom surface of the shaft adapter;

wherein:

a centerpoint of the first first-type coupler is offset from a centerpoint of the bottom surface of the shaft receiver;

a centerpoint of the first second-type coupler is offset from a centerpoint of the bottom surface of the shaft adapter;

the first first-type coupler is closer in proximity to the centerpoint of the bottom surface of the shaft receiver than the second first-type coupler;

the shaft adapter is configured to couple with an end of a club shaft;

the first second-type coupler is configured to interlock with the first first-type coupler to restrict a rotational movement of the shaft adapter relative to the shaft receiver;

the second second-type coupler is configured to interlock with the second first-type coupler when the first second-type coupler is interlocked with the first first-type coupler; and when interlocked, the one or more first-type and the one or more second-type couplers maintain an orientation of the club shaft relative to the club head.

2. The golf club mechanism of claim 1, wherein:

a tapering of the first second-type coupler is incompatible with a tapering of the second first-type coupler;

a tapering of the first first-type coupler is complementary with the tapering of the first second-type coupler; and the tapering of the second first-type coupler is complementary with a tapering of the second second-type coupler.

3. The golf club mechanism of claim 1, wherein:

at least a portion of an outer wall of the shaft adapter is configured to taper non-complementarily to an inner wall of the shaft receiver.

4. The golf club mechanism of claim 1, wherein:

a tapering of the first first-type coupler is complementary with a tapering of the first second-type coupler; and when the first second-type coupler and the first first-type coupler are interlocked, a first gap lies between a bottom of the first second-type coupler and a bottom of the first first-type coupler.

5. The golf club mechanism of claim 4, wherein:

the first gap is circumscribed by a continued tapering of the inner wall of the first first-type coupler past the bottom of the first second-type coupler.

6. The golf club mechanism of claim 1, wherein:

when the first second-type coupler and the first first-type coupler are interlocked, a gap lies between the bottom surface of the shaft receiver and the bottom surface of the shaft adapter.

7. The golf club mechanism of claim 1, wherein:

one of the first first-type coupler or the first second-type coupler comprises an male sidewall;

a different one of the first first-type coupler or the first second-type coupler comprises an female sidewall; and when the first second-type coupler and the first first-type coupler are interlocked:

an interlock portion of the male sidewall comprises any portion of the male sidewall located within a volume defined by the female sidewall; and the interlock portion of the male sidewall is fully seated against the female sidewall.

8. The golf club mechanism of claim 1, further comprising:

a cap comprising a first inner perimeter configured to at least partially circumscribe an exterior perimeter of the club shaft;

wherein the cap is configured to couple to a top portion of the shaft receiver to maintain the one or more second-type couplers interlocked with the one or more first-type couplers.

9. The golf club mechanism of claim 8, wherein:

the cap further comprises an external flange; and a gap lies between the external flange and a top end of the shaft receiver when the first second-type coupler is interlocked with the first first-type coupler and the cap is coupled to the top portion of the shaft receiver.

10. The golf club mechanism of claim 8, wherein:

the shaft receiver further comprises a shaft receiver fastener at the top portion of the shaft receiver;

the cap further comprises:

a cap flange; and a cap fastener complementary to the shaft receiver fastener;

the cap flange pushes the shaft adapter towards the bottom surface of the shaft receiver when the cap fastener is coupled to the shaft receiver fastener; and the cap flange comprises an interior flange between the first inner perimeter and a second inner perimeter of the cap, where the second inner perimeter is configured to circumscribe an exterior perimeter of a top portion of the shaft adapter.

11. The golf club mechanism of claim 8, wherein:

the shaft receiver further comprises a shaft receiver fastener at the top portion of the shaft receiver;

the cap further comprises a cap fastener complementary to the shaft receiver fastener; and the shaft receiver fastener and the cap fastener are threaded fasteners.

12. The golf club mechanism of claim 1 wherein:

the one or more first-type couplers comprise female couplers extended through the bottom surface of the shaft receiver; and the one or more second-type couplers comprise male couplers protruded from the bottom surface of the shaft adapter.

13. The golf club mechanism of claim 1, wherein:

the shaft receiver of the club head comprises a hose extending from a body of the club head, the hosel comprising a single piece with the body.

14. The golf club mechanism of claim 1, wherein:

the shaft receiver of the club head comprises a bore into a body of the club head.

15. The golf club mechanism of claim 1, wherein:

the one or more second-type couplers comprises two or more second-type couplers; and a midpoint between the two or more second-type couplers is offset from a centerpoint of the bottom surface of the shaft receiver.

16. The golf club mechanism of claim 1, wherein:

a length of the first second-type coupler is shorter than a depth of the first first-type coupler.

17. The golf club mechanism of claim 1, wherein:

the first first-type coupler has a first constant perimeter;

the first second-type coupler has a second constant perimeter; and the first first-type coupler and the first second-type coupler interlock at an interface between the first constant perimeter and the second constant perimeter without seating against each other.

18. The golf club mechanism of claim 1, further comprising:

a cap comprising:

a first inner perimeter configured to at least partially circumscribe an exterior perimeter of the club shaft;

a cap flange; and a cap fastener;

wherein:

the cap is configured to couple to a top portion of the shaft receiver to maintain the one or more second-type couplers interlocked with the one or more first-type couplers;

the shaft receiver further comprises a shaft receiver fastener at the top portion of the shaft receiver;

the cap fastener is complementary to the shaft receiver fastener;

the cap flange pushes the shaft adapter towards the bottom surface of the shaft receiver when the cap fastener is coupled to the shaft receiver fastener; and the cap flange comprises an interior flange between the first inner perimeter and a second inner perimeter of the cap, where the second inner perimeter is configured to circumscribe an exterior perimeter of a top portion of the shaft adapter.

19. The golf club mechanism of claim 1, wherein:

a bottom wall portion of the shaft adapter is not parallel with a bottom wall portion of the shaft receiver when the first second-type coupler interlocks with the first first-type coupler.

20. A golf club mechanism comprising:

a first first-type coupler of one or more first-type couplers at a bottom surface of a shaft receiver of a club head; and a first second-type coupler of one or more second-type couplers at a bottom surface of a shaft adapter;

wherein:

a centerpoint of the first first-type coupler is offset from a centerpoint of the bottom surface of the shaft receiver;

a centerpoint of the first second-type coupler is offset from a centerpoint of the bottom surface of the shaft adapter;

the shaft adapter is configured to couple with an end of a club shaft;

the first second-type coupler is configured to interlock with the first first-type coupler to restrict a rotational movement of the shaft adapter relative to the shaft receiver; and a bottom wall portion of the shaft adapter is configured to taper away from a bottom wall portion of the shaft receiver when the first second-type coupler interlocks with the first first-type coupler.

21. The golf club mechanism of claim 20, further comprising:

a second first-type coupler of the one or more first-type couplers at the bottom surface of the shaft receiver of the club head; and a second second-type coupler of the one or more second-type couplers at the bottom surface of the shaft adapter;

wherein:

the second second-type coupler is configured to interlock with the second first-type coupler when the first second-type coupler is interlocked with the first first-type coupler; and when interlocked, the one or more first-type and second-type couplers maintain an orientation of the club shaft relative to the club head.

22. The golf club mechanism of claim 20, wherein:

the one or more first-type couplers comprises two or more first-type couplers; and a midpoint between the two or more first-type couplers is offset from a centerpoint of the bottom surface of the shaft receiver.

23. The golf club mechanism of claim 20, wherein:

the bottom wall portion of the shaft receiver is configured to taper toward the bottom wall portion of the shaft adapter when the first second-type coupler interlocks with the first first-type coupler.

24. A golf club mechanism comprising:

a first first-type coupler of one or more first-type couplers at a bottom surface of a shaft receiver of a club head;

a first second-type coupler of one or more second-type couplers at a bottom surface of a shaft adapter;

a cap comprising a first inner perimeter configured to at least partially circumscribe an exterior perimeter of the club shaft; and a ferrule comprising:

a stress-dissipating material;

the first inner perimeter to circumscribe the exterior perimeter of the club shaft;

a first portion located above a top end of the cap; and a second portion located between the club shaft and the cap;

wherein:

a centerpoint of the first first-type coupler is offset from a centerpoint of the bottom surface of the shaft receiver;

a centerpoint of the first second-type coupler is offset from a centerpoint of the bottom surface of the shaft adapter;

the shaft adapter is configured to couple with an end of a club shaft;

the first second-type coupler is configured to interlock with the first first-type coupler to restrict a rotational movement of the shaft adapter relative to the shaft receiver;

the cap is configured to couple to a top portion of the shaft receiver to maintain the one or more second-type couplers interlocked with the one or more first-type couplers; and the cap comprises a cap material that is at least one of harder, stiffer, or denser than the stress-dissipating material.

25. A golf club mechanism comprising:

a first first-type coupler of one or more first-type couplers at a bottom surface of a shaft receiver of a club head;

a first second-type coupler of one or more second-type couplers at a bottom surface of a shaft adapter;

a second first-type coupler of the one or more first-type couplers at the bottom surface of the shaft receiver of the club head; and a second second-type coupler of the one or more second-type couplers at the bottom surface of the shaft adapter;

wherein:

a centerpoint of the first first-type coupler is offset from a centerpoint of the bottom surface of the shaft receiver;

a centerpoint of the first second-type coupler is offset from a centerpoint of the bottom surface of the shaft adapter;

the first first-type coupler is closer in proximity to the centerpoint of the bottom surface of the shaft receiver than the second first-type coupler;

the shaft adapter is configured to couple with an end of a club shaft;

the first second-type coupler is configured to interlock with the first first-type coupler to restrict a rotational movement of the shaft adapter relative to the shaft receiver;

one of the first first-type coupler or the first second-type coupler comprises a male sidewall with a male conical tapering portion;

a different one of the first first-type coupler or the first second-type coupler comprises a female sidewall with a female conical tapering portion; and when the first first-type coupler is interlocked with the first second-type coupler:

an interlock portion of the male conical tapering portion of the male sidewall is located within a volume defined by the female sidewall; and the interlock portion of the male sidewall is seated against the female conical tapering portion of the female sidewall.

26. A golf club mechanism comprising:

a first first-type coupler of one or more first-type couplers at a bottom surface of a shaft receiver of a club head;

a first second-type coupler of one or more second-type couplers at a bottom surface of a shaft adapter;

a second first-type coupler of the one or more first-type couplers at the bottom surface of the shaft receiver of the club head; and a second second-type coupler of the one or more second-type couplers at the bottom surface of the shaft adapter;

wherein:

a centerpoint of the first first-type coupler is offset from a centerpoint of the bottom surface of the shaft receiver;

a centerpoint of the first second-type coupler is offset from a centerpoint of the bottom surface of the shaft adapter;

the shaft adapter is configured to couple with an end of a club shaft;

the first second-type coupler is configured to interlock with the first first-type coupler to restrict a rotational movement of the shaft adapter relative to the shaft receiver;

a tapering of the first first-type coupler is non-parallel to a central longitudinal axis of the first first-type coupler;

a tapering of the first second-type coupler is non-parallel to a central longitudinal axis of the first second-type coupler;

the tapering of the first first-type coupler is complementary with the tapering of the first second-type coupler;

a tapering of the second first-type coupler is complementary with a tapering of the second second-type coupler; and the tapering of the first second-type coupler is incompatible with the tapering of the second first-type coupler.

27. The golf club mechanism of claim 26, wherein:

when the first second-type coupler and the first first-type coupler are interlocked:

the first first-type coupler and the second first-type coupler are non-tiltable relative to each other; and a first gap lies between a bottom of the first second-type coupler and a bottom of the first first-type coupler.

28. A golf club mechanism comprising:

a first first-type coupler of one or more first-type couplers at a bottom surface of a shaft receiver of a club head;

a first second-type coupler of one or more second-type couplers at a bottom surface of a shaft adapter;

a second first-type coupler of the one or more first-type couplers at the bottom surface of the shaft receiver of the club head; and a second second-type coupler of the one or more second-type couplers at the bottom surface of the shaft adapter; wherein:

a centerpoint of the first first-type coupler is offset from a centerpoint of the bottom surface of the shaft receiver;

a centerpoint of the first second-type coupler is offset from a centerpoint of the bottom surface of the shaft adapter;

the shaft adapter is configured to couple with an end of a club shaft;

the first second-type coupler is configured to interlock with the first first-type coupler to restrict a rotational movement of the shaft adapter relative to the shaft receiver;

a tapering of the first first-type coupler is non-parallel to a central longitudinal axis of the first first-type coupler;

a tapering of the first second-type coupler is non-parallel to a central longitudinal axis of the first second-type coupler;

the tapering of the first first-type coupler is complementary with the tapering of the first second-type coupler; and the first first-type coupler is closer in proximity to the centerpoint of the bottom surface of the shaft receiver than the second first-type coupler.

* * * * *